US011151925B2

(12) United States Patent
Park et al.

(10) Patent No.: US 11,151,925 B2
(45) Date of Patent: Oct. 19, 2021

(54) DISPLAY DEVICE AND DRIVING METHOD THEREOF

(71) Applicant: LG Display Co., Ltd., Seoul (KR)

(72) Inventors: Hye Min Park, Paju-si (KR); Dong Yoon Lee, Paju-si (KR); Jin Woo Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/113,988

(22) Filed: Dec. 7, 2020

(65) Prior Publication Data

US 2021/0183299 A1 Jun. 17, 2021

(30) Foreign Application Priority Data

Dec. 16, 2019 (KR) ..... 10-2019-0168032

(51) Int. Cl.
*G09G 3/20* (2006.01)
*G09G 3/3275* (2016.01)
*G09G 3/3266* (2016.01)

(52) U.S. Cl.
CPC ..... *G09G 3/2074* (2013.01); *G09G 3/2003* (2013.01); *G09G 3/3266* (2013.01); *G09G 3/3275* (2013.01); *G09G 2300/0452* (2013.01); *G09G 2310/08* (2013.01); *G09G 2320/045* (2013.01)

(58) Field of Classification Search
CPC .. G09G 3/2074; G09G 3/3275; G09G 3/3266; G09G 3/2003; G09G 2320/045; G09G 2310/08; G09G 2300/0452
See application file for complete search history.

(56) References Cited

U.S. PATENT DOCUMENTS

| | | | | |
|---|---|---|---|---|
| 9,035,976 | B2 * | 5/2015 | Lee | G09G 5/10 345/691 |
| 9,349,311 | B2 * | 5/2016 | Yu | G09G 3/3291 |
| 9,424,782 | B2 * | 8/2016 | Park | H01L 27/3276 |
| 9,449,560 | B2 * | 9/2016 | Oh | G09G 3/3283 |
| 9,542,873 | B2 * | 1/2017 | Yu | G09G 3/006 |
| 10,062,327 | B2 * | 8/2018 | Tani | G09G 3/3233 |
| 10,229,636 | B2 * | 3/2019 | Kim | G09G 3/3233 |
| 10,235,937 | B2 * | 3/2019 | Li | G09G 3/3258 |
| 2014/0022289 | A1 * | 1/2014 | Lee | G09G 3/006 345/691 |
| 2015/0379909 | A1 * | 12/2015 | Yu | G09G 3/3258 345/690 |
| 2016/0012798 | A1 * | 1/2016 | Oh | G09G 3/325 345/205 |

(Continued)

FOREIGN PATENT DOCUMENTS

| | | |
|---|---|---|
| KR | 10-2017-0064176 A | 6/2017 |
| KR | 10-2018-0025038 A | 3/2018 |
| KR | 10-2019-0030060 A | 3/2019 |

*Primary Examiner* — Michael J Jansen, II
(74) *Attorney, Agent, or Firm* — Fenwick & West LLP

(57) ABSTRACT

Disclosed are a light emitting display device and a driving method thereof, wherein a sensing mode of the display device includes a first sensing step in which an electrical characteristic of a first sub-pixel is sensed, a first initialization step set in advance of the first sensing step, a second sensing step in which an electrical characteristic of the second sub-pixel is sensed, and a second initialization step set in advance of the second sensing step.

16 Claims, 20 Drawing Sheets

(56) References Cited

U.S. PATENT DOCUMENTS

| | | | | |
|---|---|---|---|---|
| 2016/0189617 | A1* | 6/2016 | Park | G09G 5/10 345/690 |
| 2016/0240122 | A1* | 8/2016 | Yu | G09G 3/006 |
| 2016/0351096 | A1* | 12/2016 | Tani | G09G 3/3233 |
| 2017/0132977 | A1* | 5/2017 | Kim | G09G 3/3266 |
| 2017/0132979 | A1* | 5/2017 | Oh | G09G 3/3233 |
| 2018/0012546 | A1* | 1/2018 | Li | G09G 3/3233 |
| 2021/0166637 | A1* | 6/2021 | Cho | G09G 3/3291 |

* cited by examiner

FIG. 14

| Sensing sequence | Pixel Line No. | Repetition Number | Sensing CH |
|---|---|---|---|
| N times continuous sensing | L1 | N times | ODD |
| | L1 | | ODD |
| | L1 | | ODD |
| | L1 | | ODD |
| | L1 | | ODD |
| | L1 | | ODD |
| | L1 | | ODD |
| | L1 | | ODD |
| NO sensing | Initial mode | | |
| N times continuous sensing | L1 | N times | EVEN |
| | L1 | | EVEN |
| | L1 | | EVEN |
| | L1 | | EVEN |
| | L1 | | EVEN |
| | L1 | | EVEN |
| | L1 | | EVEN |
| | L1 | | EVEN |
| NO sensing | Initial mode | | |
| N times continuous sensing | L2 | N times | ODD |
| | L2 | | ODD |
| | L2 | | ODD |
| | L2 | | ODD |
| | L2 | | ODD |
| | L2 | | ODD |
| | L2 | | ODD |
| | L2 | | ODD |
| NO sensing | Initial mode | | |
| N times continuous sensing | L2 | N times | EVEN |
| | L2 | | EVEN |
| | L2 | | EVEN |
| | L2 | | EVEN |
| | L2 | | EVEN |
| | L2 | | EVEN |
| | L2 | | EVEN |
| | L2 | | EVEN |

[ODD CH continuous sensing]

[EVEN CH continuous sensing]

FIG. 20

| Sensing sequence | Pixel Line | Repetition Number | Sensing CH |
|---|---|---|---|
| 1 | L1 | 1 | ODD CH |
| 2 | L1 | 2 | ODD CH |
| 3 | L1 | 3 | ODD CH |
| 4 | L1 | 4 | ODD CH |
| 5 | L1 | 5 | ODD CH |
| 6 | L1 | 6 | ODD CH |
| 7 | L1 | 7 | ODD CH |
| 8 | L1 | 8 | ODD CH |
| 9 | L2 | 1 | ODD CH |
| 10 | L2 | 2 | ODD CH |
| ▼ 11 | L2 | 3 | ODD CH |
| 12 | L2 | 4 | ODD CH |
| 13 | L2 | 5 | ODD CH |
| 14 | L2 | 6 | ODD CH |
| 15 | L2 | 7 | ODD CH |
| 16 | L2 | 8 | ODD CH |

| Sensing sequence | Pixel Line | Repetition Number | Sensing CH |
|---|---|---|---|
| 1 | L1 | 1 | EVEN |
| 2 | L1 | 2 | EVEN |
| 3 | L1 | 3 | EVEN |
| 4 | L1 | 4 | EVEN |
| 5 | L1 | 5 | EVEN |
| 6 | L1 | 6 | EVEN |
| 7 | L1 | 7 | EVEN |
| 8 | L1 | 8 | EVEN |
| 9 | L2 | 1 | EVEN |
| 10 | L2 | 2 | EVEN |
| ▼ 11 | L2 | 3 | EVEN |
| 12 | L2 | 4 | EVEN |
| 13 | L2 | 5 | EVEN |
| 14 | L2 | 6 | EVEN |
| 15 | L2 | 7 | EVEN |
| 16 | L2 | 8 | EVEN |

Inserting initialization step just before changing frame

DISPLAY DEVICE AND DRIVING METHOD THEREOF

CROSS-REFERENCE TO RELATED APPLICATIONS

This application claims priority to and the benefit of Republic of Korea Patent Application No. 10-2019-0168032, filed on Dec. 16, 2019, the disclosure of which is incorporated herein by reference in its entirety.

BACKGROUND

Field

The present disclosure relates to a display device that senses electrical characteristics of sub-pixels.

Discussion of Related Art

An electroluminescent display device is roughly classified into an inorganic light emitting display device and an organic light emitting display device according to the material of a light emitting layer. The organic light emitting display device having an active matrix type includes a light emitting element that emits light by itself. Accordingly, there are advantages that the response speed is fast, and light emitting efficiency, brightness, and viewing angle are large. The light emitting element may be an organic light emitting diode (hereinafter, referred to as "OLED"). Since the organic light emitting display device may express black gradation in complete black, it is possible to reproduce an image at an excellent level in terms of contrast ratio and color reproduction.

The pixels of the organic light emitting display device include an OLED and a driving element for supplying a current to the OLED according to a gate-source voltage to drive the OLED. The OLED of the organic light emitting display device includes an anode and a cathode, and an organic compound layer formed between the anode and the cathode. The organic compound layer includes a hole injection layer (HIL), a hole transport layer (HTL), an emission layer (EML), an electron transport layer (ETL) and an electron injection layer (EIL). When a current flows through the OLED, holes passing through the hole transport layer (HTL) and electrons passing through the electron transport layer (ETL) are moved to the emission layer (EML) to form excitons, and as a result, the emission layer (EML) generates visible light.

The driving element may be implemented with a TFT having a metal oxide semiconductor field effect transistor (MOSFET) structure. The driving element should have uniform electrical characteristics among all pixels, but may have differences between the pixels due to process deviations and device characteristics deviations, and may change according to the elapse of display driving time. In order to compensate for deviations in electrical characteristics of the driving element, an internal compensation method and an external compensation method may be applied to the organic light emitting display device. The internal compensation method samples the gate-source voltage Vgs of the driving element that changes according to the electrical characteristics of the driving element to compensate a data voltage by the gate-source voltage. The driving element may be implemented with a transistor. The external compensation method compensates for deviations in the electrical characteristics of the driving elements between pixels by sensing the voltages of the pixels that change according to the electrical characteristics of the driving element and modulating the data of the input image in the external circuit based on the sensed voltage.

SUMMARY

In the external compensation method, the sensing value of the pixel should be correct, so that the deterioration of the pixel may be accurately compensated. However, the pixel sensing value may vary depending on the driving environment of the pixel before sensing.

The present disclosure is to solve the aforementioned needs and/or problems.

The present disclosure provides a display device capable of accurately sensing electrical characteristics of pixels by removing common noise and a driving method thereof.

The problems of the present disclosure are not limited to the problems mentioned above, and other problems not mentioned above will be clearly understood by those skilled in the art from the following description.

The display device of the present disclosure may include a display panel including data lines, sensing lines, and first and second pixels, each of which includes a plurality of sub-pixels having different colors; a data driving unit converting pixel data of an input image into a data voltage in a display driving mode to supply a converted data voltage to the data lines, and converting sensing data and black gradation data into a voltage in the sensing mode to supply a converted voltage to the data lines; a gate driving unit supplying a gate signal to the pixels of the display panel, and a double sampling device sensing electrical characteristics of the first and second sub-pixels in the sensing mode.

The sensing mode may include a first sensing step in which the electrical characteristic of the first sub-pixel is sensed, a first initialization step set in advance of the first sensing step, a second sensing step in which the electrical characteristic of the second sub-pixel is sensed, and a second initialization step set in advance of the second sensing step.

In the first initialization step, a black gradation voltage corresponding to the black gradation data may be supplied to the first and second sub pixels through data lines. In the first sensing step, a sensing data voltage corresponding to the sensing data may be supplied to the first sub-pixel through data lines, and the black gradation voltage may be supplied to the second sub-pixel through data lines so that the electrical characteristic of the first sub-pixel may be sensed as a result of subtraction of the sensing data voltage and the black gradation voltage. In the second initialization step, the black gradation voltage corresponding to the black gradation data may be supplied to the first and second sub pixels. In the second sensing step, the sensing data voltage is supplied to the second sub-pixel through data lines, and the black gradation voltage is supplied to the first sub-pixel through data lines so that the electrical characteristic of the second sub-pixel is sensed as a result of subtraction of the sensing data voltage and the black gradation. The black gradation voltage may be a pixel voltage at which the luminance of pixels is minimal, that is, the pixels appear in black color.

A driving method of the display device may include setting a first initialization step, a first sensing step, a second initialization step, and a second sensing step in a sensing mode, converting pixel data of an input image into a data voltage in a display driving mode to supply a converted data voltage to the first sub-pixel disposed in the first pixel and the second sub-pixel disposed in the second pixel, supplying a black gradation voltage to the first and second sub-pixels in the first initialization step, supplying a sensing data voltage to the first sub-pixel, and supplying the black gradation voltage to the second sub-pixel to sense an electrical characteristic of the first sub-pixel using the subtraction result of the sensing data voltage and the black gradation voltage, in the first sensing step, supplying the black gradation voltage corresponding to the first and second sub-pixels, in the second initialization step, and supplying the sensing data voltage to the second sub-pixel, and supplying the black gradation voltage to the first sub-pixel to sense an electrical characteristic of the second sub-pixel using the subtraction result of the sensing data voltage and the black gradation voltage, in the second sensing step.

BRIEF DESCRIPTION OF THE DRAWINGS

The above and other objects, features and advantages of the present disclosure will become more apparent to those of ordinary skill in the art by describing exemplary embodiments thereof in detail with reference to the attached drawings, in which:

FIGS. 13 and 14 are diagrams showing an example in which an initialization step and a sensing step are continuously performed according to an embodiment of the present disclosure.

FIGS. 19 and 20 are diagrams illustrating an example in which electrical characteristics of all odd-numbered pixels in a pixel array are sensed in a first sensing step, and electrical characteristics of all odd-numbered pixels in the pixel array are sensed in a second sensing step according to an embodiment of the present disclosure.

DETAILED DESCRIPTION

Figure 1:
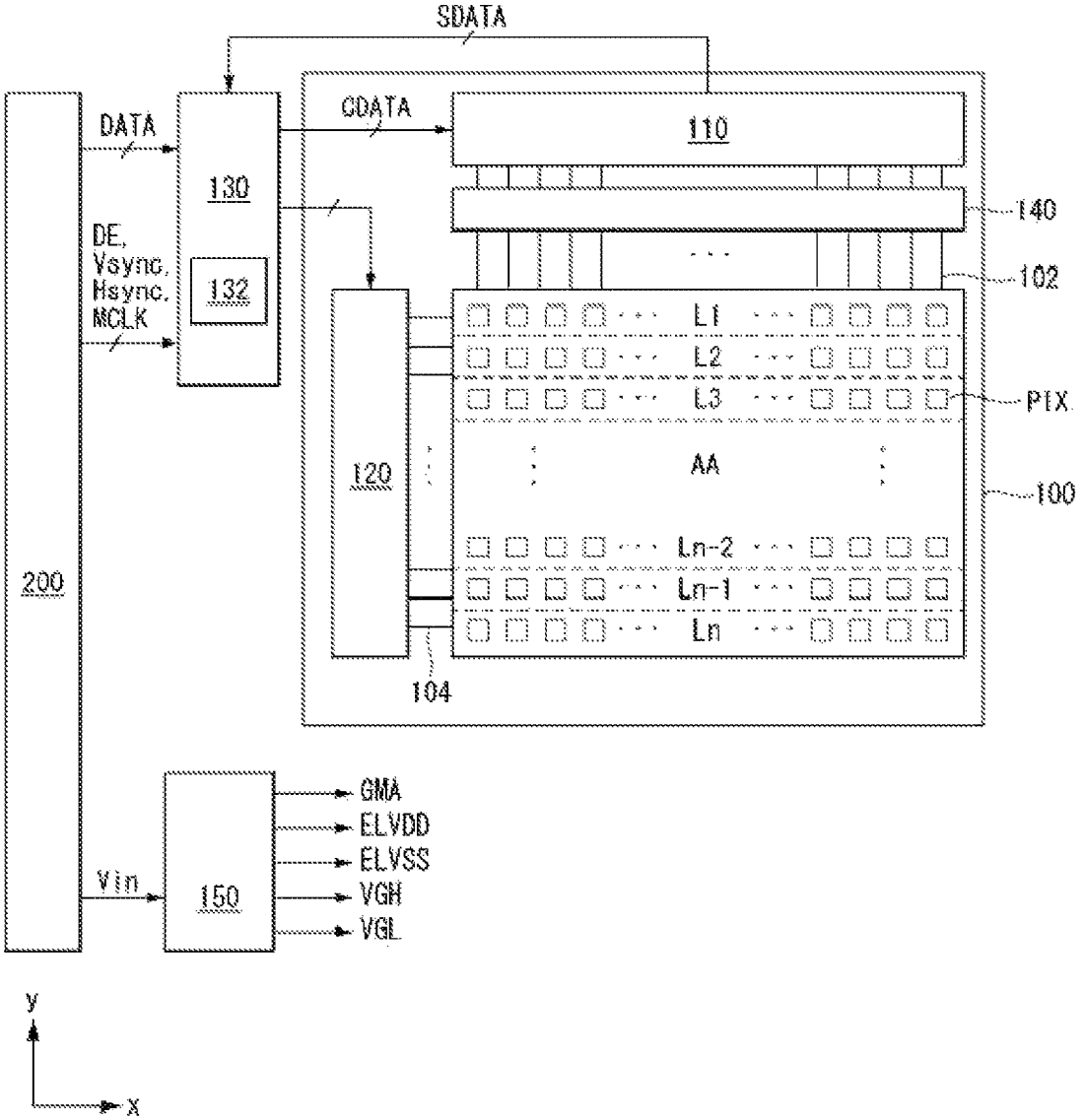
FIG. 1 is a schematic block diagram showing a display device according to an exemplary embodiment of the present disclosure.

Advantages and features of the present disclosure, and implementation methods thereof will be clarified by the following embodiments described with reference to the accompanying drawings. However, the present disclosure is not limited to embodiments disclosed below, but will be implemented in various different forms. Only the embodiments are provided to make the disclosure of the present disclosure complete and to fully convey the scope of the present disclosure to those skilled in the art. It is to be noted that the scope of the present disclosure is only defined by the claims.

The shapes, sizes, ratios, angles, numbers, etc. disclosed in the drawings for describing the embodiments of the present disclosure are merely illustrative and are not limited to the illustrated matters in the present disclosure. The same reference numerals throughout the specification refer to the same components. In addition, in the description of the present disclosure, when it is determined that detailed descriptions of related known technologies may unnecessarily obscure the subject matter of the present disclosure, detailed descriptions thereof will be omitted.

Terms such as "including", "having" and "comprising" used herein are intended to allow other elements to be added unless the terms are used with the term "only." Any references to singular may include plural unless expressly stated otherwise.

Components are interpreted to include an ordinary error range even if not expressly stated.

For description of positional relationships, for example, when the positional relationship between two parts is described as "on," "above," "below," "next to," and the like, one or more parts may be interposed therebetween unless the term "immediately" or "directly" is used in the expression.

In the description of the embodiments, the first, second, etc. are used to describe various components, but these components are not limited by these terms. These terms are only used to distinguish one component from another component. Therefore, a first component mentioned below may be a second component within the technical spirit of the present disclosure.

The features of various embodiments of the present disclosure may be partially or entirely bonded to or combined with each other. The embodiments may be interoperated and performed in various ways technically and may be carried out independently of or in association with each other.

A pixel circuit and gate driving unit of the present disclosure may include transistors formed on a substrate of a display panel. The transistors may be implemented with an oxide TFT (Thin Film Transistor) including an oxide semiconductor, an LTPS TFT including a Low Temperature Poly Silicon (LTPS) and the like. In addition, each of the transistors may be implemented with a p-type TFT or an n-type TFT.

The transistors are three-electrode elements including a gate, a source, and a drain. The source of the transistor is an electrode that supplies carriers to the transistor. In the transistor, the carriers begin to flow from the source. The drain is an electrode from which carriers are moved out of the transistor. In the transistor, the carriers move from the source to the drain. In the case of an n-channel transistor (NMOS), the carriers are electrons. Thus, the source voltage is lower than the drain voltage so that the electrons move from the source to the drain. In the n-channel transistor (NMOS), the direction of a current is from the drain to the source. In the case of a p-channel transistor (PMOS), the carriers are holes. Thus, the source voltage is higher than the drain voltage so that the holes may move from the source to the drain. In the p-channel transistor (PMOS), the direction of a current is from the source to the drain because the holes move from the source to the drain. It should be noted that the source and drain of the transistor are not fixed. For example, the source and drain of the transistor may be changed depending on an applied voltage. Therefore, the present disclosure is not limited due to the source and drain of the transistor. In the following description, the source and drain of the transistor will be referred to as first and second electrodes.

A gate signal output from the gate driving unit swings between a gate-on voltage and a gate-off voltage. The gate-on voltage is set to a voltage higher than a threshold voltage of the transistor, and the gate-off voltage is set to a voltage lower than the threshold voltage of the transistor. The transistor is turned on in response to the gate-on voltage, while it is turned off in response to the gate-off voltage. In the case of an n-channel transistor, the gate-on voltage may be a Gate High Voltage (VGH), and the gate-off voltage may be a Gate Low Voltage (VGL). In the case of a p-channel transistor, the gate-on voltage may be the Gate Low Voltage (VGL) and the gate-off voltage may be the Gate High Voltage (VGH).

Hereinafter, various embodiments of the present disclosure will be described in detail with reference to the accompanying drawings.

Referring to FIG. 1, a display device according to an exemplary embodiment of the present disclosure includes a display panel 100 and a display panel driving unit.

The display device of the present disclosure operates in a display driving mode (a normal driving mode) for displaying an input image on a screen, and a sensing mode for sensing electrical characteristics of pixels. The electrical characteristics of the pixels may be an operating point or threshold voltage Vth of each light emitting element (OLED) of the pixels and a capacitance of the light emitting element (OLED). Herein, the capacitance of the light emitting element (OLED) may be an internal capacitance of the light emitting element (OLED) or a capacitance of a capacitor (Coled in FIG. 4) connected to both ends of the light emitting element (OLED).

In the display driving mode, the display panel driving unit writes pixel data of an input image to the pixels every frame period under the control of a timing controller 130. In the sensing mode, the display panel driving unit senses deterioration of the light emitting elements by sensing pixels under the control of the timing controller 130. When a power-off command of the display device is input, the sensing mode may be entered after the last frame of the display driving mode or the sensing mode may be executed at a preset time period. In this case, when the power-off command of the display device is input, a power-off sequence is not executed immediately, and the power-off sequence may be executed after the sensing mode to turn off the power of the display device. In another embodiment, the sensing mode may be entered according to a user input.

The screen of the display panel 100 includes a pixel array AA. The pixel array AA includes a plurality of data lines 102, a plurality of gate lines 104 intersecting the data lines 102, and pixels arranged in a matrix form. The data lines 102 are implemented with a long wiring in a first direction (y-axis direction), and the gate lines 104 may be implemented with the long wiring in a second direction (x-axis direction) orthogonal to the first direction (y-axis direction).

When the resolution of the pixel array AA is m*n, the pixel array includes m (m is a positive integer greater than or equal to 2) pixel columns, and n (n is a positive integer greater than or equal to 2) pixel lines L1 to Ln intersecting the pixel columns. The pixel column includes pixels arranged along the y-axis direction. The pixel line includes pixels PIX arranged along the x-axis direction. One vertical period is one frame period required to write the pixel data of one frame to all pixels PIX of the screen in the display driving mode. It is the time required to be written to pixels of one pixel line sharing the gate line. One horizontal period is the time obtained by dividing one frame period by the number of n pixel lines L1 to Ln, that is, the vertical resolution of the display panel 100.

Figure 2:
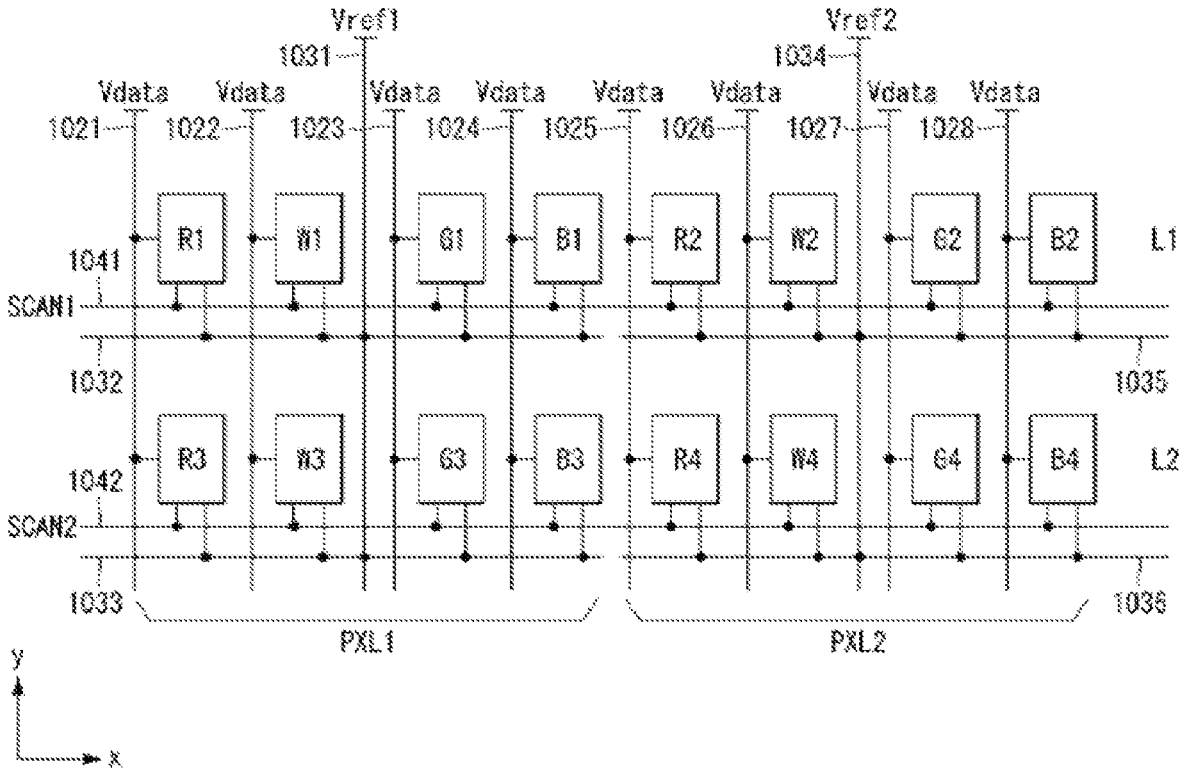
FIG. 2 is a view showing an example of a pixel according to an embodiment of the present disclosure.
Figure 4:
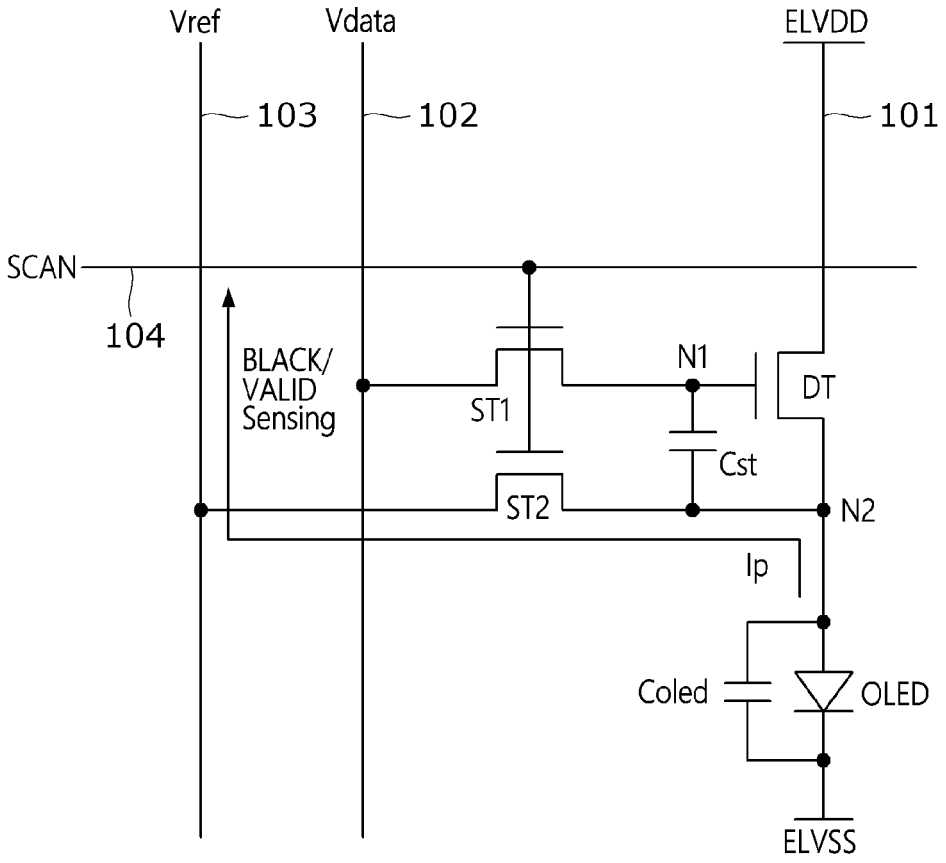
FIG. 4 is an equivalent circuit diagram showing a pixel circuit of the sub-pixel shown in FIG. 3 according to an embodiment of the present disclosure.

Each of the pixels PIX includes a red sub-pixel (hereinafter referred to as "R sub-pixel"), a green sub-pixel (hereinafter referred to as "G sub-pixel"), a blue sub-pixel (hereinafter referred to as "B sub-pixel"), and a white sub-pixel (hereinafter referred to as "W sub-pixel") in order to realize colors, as shown in FIG. 2. Each of the sub-pixels may include a pixel circuit as shown in FIG. 4. Hereinafter, red, green, blue, and white sub-pixels disposed in one pixel PIX will be referred to as "R, G, B, and W sub-pixels". Hereinafter, a pixel may be interpreted as a sub-pixel.

Touch sensors may be disposed on the display panel 100. A touch input may be sensed using separate touch sensors or may be sensed through pixels. The touch sensors may be implemented as in-cell type touch sensors disposed on the screen of the display panel or embedded in the pixel array AA by an On-cell type or an Add-on type.

The display panel driving unit includes a data driving unit 110, a gate driving unit 120, a timing controller 130, and a power supply unit 150. A demultiplexer 140 disposed between the data driving unit 110 and the data lines 102 may be disposed.

The display panel driving unit displays the input image on the screen by writing the pixel data of the input image to the pixels of the display panel 100 under the control of the timing controller 130 in the display driving mode. The display panel driving unit senses the electrical characteristics of each light emitting element, for example, OLED, and the capacitance of the OLED of the pixels, in the sensing mode, and compensates for the electrical characteristics of the OLED based on the sensing results. The electrical characteristics of the OLED may be the operating point voltage (or threshold voltage) of the OLED. The operating point voltage of the OLED is a voltage at which an anode voltage of the OLED rises and the OLED starts to emit light.

In a mobile device or a wearable device, the data driving unit 110, the timing controller 130, and the power supply unit 150 may be integrated in one drive integrated circuit (IC).

The data driving unit 110 receives pixel data CDATA of an input image, sensing data VALID and black gradation data received from the timing controller 130. The data driving unit 110 divides a gamma reference voltage GMA to generate a gamma compensation voltage for each gradation of the pixel data and supplies a generated gamma compensation voltage to a digital-to-analog converter (hereinafter referred to as "DAC").

The data driving unit 110 converts the pixel data CDATA to the gamma compensation voltage using the DAC in the display driving mode and outputs a data voltage Vdata to the data lines 102. The data driving unit 110 converts the sensing data and the black gradation data into the gamma compensation voltage and outputs a sensing data voltage to the data lines 102. Accordingly, the data voltage Vdata output from the data driving unit 110 may be divided into a sensing data voltage generated in the sensing mode and a data voltage of the pixel data generated in the display driving mode.

In the display driving mode, the data driving unit 110 may convert the pixel data of the input image into a data voltage and supply the first sub-pixels arranged in odd-numbered pixels through data lines 102 connected to the first sub-pixels and the second sub-pixels arranged in even-numbered pixels through data lines 102 connected to the second sub-pixels. In the sensing mode, the data driving unit 110 may convert the sensing data and the black gradation data into voltages to generate a sensing data voltage and a black gradation voltage, and supply the sensing data voltage and the black gradation voltage to the first and second sub-pixels alternately through data lines 102.

The sensing data VALID and the black gradation data are data stored in advance in a register of the timing controller 130 regardless of the input image. The sensing data VALID is digital data corresponding to a preset sensing data voltage to charge the anode voltage of the light emitting element OLED beyond the operating point voltage of the light emitting element OLED. The data driving unit 110 receives the sensing data to generate a sensing data voltage.

The data voltage Vdata output from the data driving unit 110 is supplied to the data lines 102. The data driving unit 110 may be implemented with one or more source drive integrated circuits (SICs). The data driving unit 110 and the sensing unit 111 may be integrated in the source drive IC (SIC).

Figure 3:
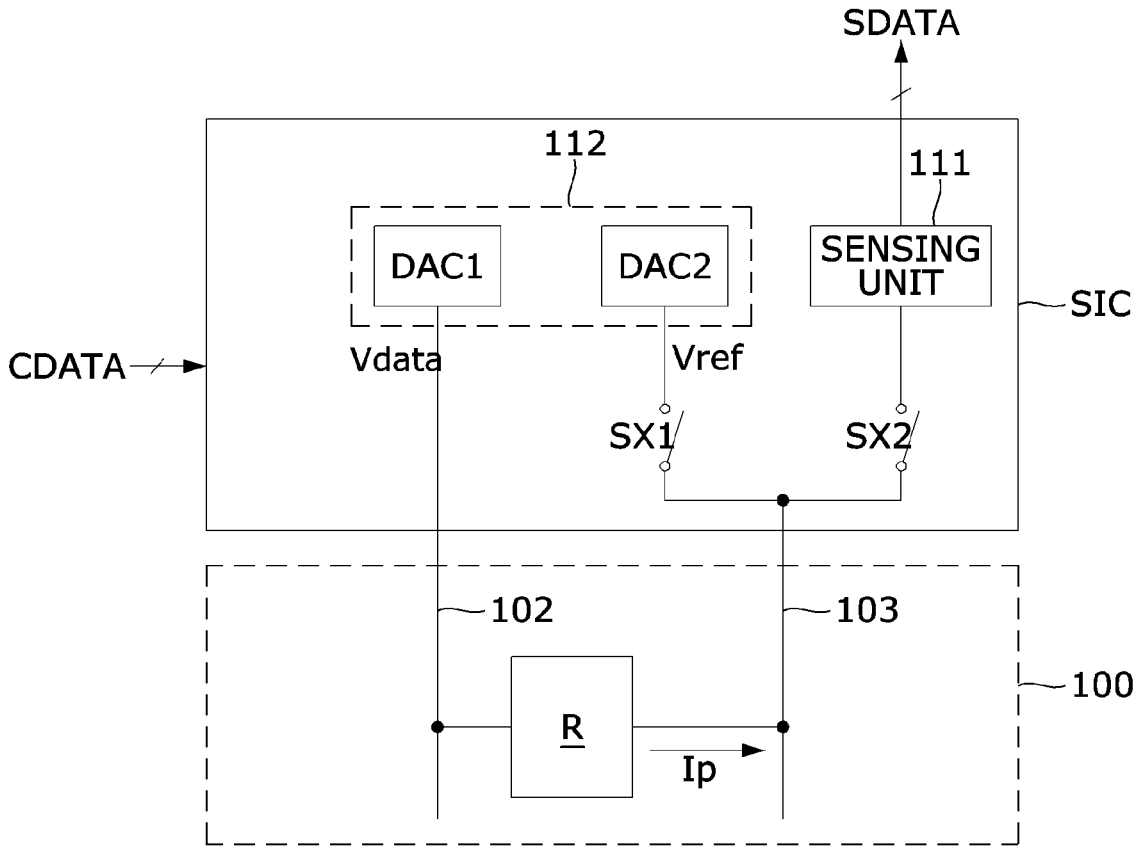
FIG. 3 is a view showing a driving voltage generation unit and a sensing unit of a source drive IC according to an embodiment of the present disclosure.

The data driving unit 110 may include a sensing unit 111 that senses deterioration of each of the sub-pixels through the sensing lines 103 as shown in FIG. 3.

The demultiplexer 140 distributes the data voltage Vdata output from the data driving unit 110 to the plurality of data lines 102 by using switch elements disposed between the data driving unit 110 and the data lines 102. Since the data voltage Vdata output from one channel of the data driving unit 110 by the demultiplexer 140 is time-divided and distributed to a plurality of data lines, the number of channels of the data driving unit 110 may be reduced.

The gate driving unit 120 may be implemented with a gate in panel (GIP) circuit formed directly on the display panel 100 together with the pixel array AA. The GIP circuit may be disposed on a bezel area of the display panel 100 outside the pixel array AA. The gate driving unit 120 outputs gate signals to the gate lines 104 under the control of the timing controller 130. The gate driving unit 120 may sequentially supply the signals to the gate lines 104 by shifting the gate signals using a shift register. The gate signal may include a scan signal SCAN1 and SCAN2 illustrated in FIG. 2. The scan signal SCAN1 and SCAN2 are synchronized with the data voltage Vdata.

The gate driving unit 120 may generate the scan signal SCAN as illustrated in FIGS. 15 to 19 in the sensing mode.

The power supply unit 150 uses a DC-DC converter to generate power required for driving the pixel array of the display panel 100 and the display panel driving unit. The DC-DC converter may include a charge pump, a regulator, a buck converter, and a boost converter. The DC-DC converter may generate a direct current power such as the gamma reference voltage GMA, a gate high voltage VGH, a pixel driving voltage ELVDD and a low potential power voltage ELVSS by adjusting a DC input voltage Vin from a host system 200. The gamma reference voltage GMA is supplied to the data driving unit 110. The gate-off voltage VGH and the gate-on voltage VGL are supplied to the gate driving unit 120. The power supply unit 150 may be implemented with a power management integrated circuit (PMIC).

The timing controller 130 receives the pixel data DATA of the input image from the host system 200 and a timing signal synchronized therewith. The timing signal received by the timing controller 130 may include a vertical synchronization signal Vsync, a horizontal synchronization signal Hsync, a main clock MCLK, a data enable signal (DE), and the like.

The timing controller 130 controls the operation timing of the display panel driving unit in the display driving mode and the sensing mode based on the timing signal received from the host system 200. One cycle of the vertical synchronization signal Vsync is one frame period. One cycle of the horizontal synchronization signal Hsync and the data enable signal DE is one horizontal period 1H. The pulse of the data enable signal DE is synchronized with the pixel data of one pixel line to be displayed on the pixels to define an effective data section. Since the frame period and the horizontal period are known by the method of counting the data enable signal DE, the vertical synchronization signal Vsync and the horizontal synchronization signal Hsync may be omitted.

The timing controller 130 generates a data timing control signal for controlling the operation timing of the data driving unit 110 based on the timing signals Vsync, Hsync, and DE received from the host system 200, a switch control signal for controlling the operation timing of the demultiplexer 112, and a gate timing control signal for controlling the operation timing of the gate driving unit 120. A voltage level of the gate timing control signal output from the timing controller 130 may be converted into a gate-on voltage and a gate-off voltage through a level shifter (not shown) and supplied to the gate driving unit 120. The level shifter converts a low level voltage of the gate timing control signal to the gate low voltage VGL, and converts a high level voltage of the gate timing control signal to the gate high voltage VGH.

The timing controller 130 may generate control signals (Init CI, SAM) of an integrator to control the operation timing of the sensing unit 111, as shown in FIGS. 15 to 18.

The timing controller 130 may adjust a frame rate to a frequency greater than or equal to an input frame frequency. For example, the timing controller 130 may multiply the input frame frequency by i times to control the operation timing of the display panel driving unit at a frame frequency of the frame frequency x i (i is a positive integer greater than 0) Hz. The frame frequency is 60 Hz in the National Television Standards Committee (NTSC) method and 50 Hz in the Phase-Alternating Line (PAL) method.

The timing controller 130 may include a compensation unit 132 as illustrated in FIG. 1.

The compensation unit 132 receives ADC data (data, SDATA) received through the sensing unit 111. Here, ADC data (analog-to-digital converter data) is a digital data output from Analog-digital converter (ADC) The compensation unit 132 detects the operating point voltage (or threshold voltage) of light emitting element (OLED) from each of the odd-numbered pixels (hereinafter referred to as "ODD pixels") and the even-numbered pixels (hereinafter referred to as "EVEN pixels") based on the result of subtraction of the even channel data and the odd channel data, and modulates the pixel data DATA by reflecting the amount of change of the detected operating point to the pixel data DATA of the input image.

The compensation unit 132 may modulate the pixel data DATA by multiplying or adding the amount of change of the operating point to the pixel data. When pixels are sensed, the sensing data (hereinafter referred to as "Valid value") is written in one of two sub-pixels of the same color among ODD pixels and EVEN pixels, and the black gradation data (hereinafter referred to as "Black value") is written in the other. The Valid value is the value of the sensing data VALID.

For example, R sub-pixels of neighboring ODD pixels and EVEN pixels may be sensed. When the R sub-pixels of the ODD pixels are sensed, a Valid value is written in the R sub-pixels of the ODD pixels, and at the same time, a Black value is written in the R sub-pixels of the EVEN pixels adjacent to the ODD pixels, such that the ODD Valid value is sensed from the ODD pixels and the ODD Black value is sensed from the EVEN pixels. When the R sub-pixels of the EVEN pixels are sensed, a Valid value is written in the R sub-pixels of the EVEN pixels, and at the same time, a black value is written in the R sub-pixels of the ODD pixels adjacent to the EVEN pixels, such that an EVEN Valid value is sensed from the EVEN pixels, and an EVEN Black value is sensed from the EVEN pixels.

The timing controller 130 transmits a modulated pixel data CDATA to the data driving unit 110 to compensate for the amount of change in the operating point of the light emitting element. The data driving unit 110 receives a pixel data CDATA modulated by the timing controller 130 and outputs a data voltage Vdata corresponding to the pixel value in the display driving mode.

FIG. 2 is a view showing an example of a pixel according to an embodiment of the present disclosure. In FIG. 2, the reference numerals "1021 to 1028" are data lines 102, and the reference numerals "1041 and 1042" are gate lines 104.

Referring to FIG. 2, ODD pixels and EVEN pixels are alternately arranged in each of the horizontal lines L1 and L2. An ODD pixel and an EVEN pixel are adjacent left and right in the line direction (x-axis) in the same pixel line. Each of the ODD pixel and the EVEN pixel in each of the horizontal lines L1 and L2 may include R, G, B, and W sub-pixels.

The ODD pixels and the EVEN pixels in each of the pixel lines L1 and L2 share the gate lines 1041 and 1042. For example, all pixels of the first pixel line L1 are connected to the first gate line 1041 to which the first scan signal SCAN1 is applied. All pixels of the second pixel line L2 are connected to the second gate line 1042 to which the second scan signal SCAN2 is applied.

The sub-pixels arranged in one column line share a data line. For example, the red sub-pixels R1 and R3 arranged in the first column line are connected to the first data line 1021. The red sub-pixels R2 and R4 arranged in a fifth column line are connected to a fifth data line 1025.

The sub-pixels of the same color between the neighboring ODD and EVEN pixels may be separated by one or more sub-pixels of different colors between them.

The sensing lines 1031 and 1034 may be implemented with long lines in which the data lines 1021 to 1028 are parallel (y-axis direction). In order to independently sense the ODD pixel and the EVEN pixel, the sensing line 103 is divided into an odd-numbered sensing line (hereinafter referred to as a first sensing line) connected to the ODD pixel, and an even-numbered sensing line (hereinafter referred to as a second sensing line) connected to the EVEN pixel.

The first sensing line 1031 supplies a first reference voltage Vref1 to the ODD pixels in each of the pixel lines L1 and L2. The first sensing line 1031 is connected to first branch lines 1032 and 1033. The first branch lines 1032 and 1033 may be implemented with a long pattern in a direction parallel to the gate lines 1041 and 1042 (x-axis direction). The first branch lines 1032 and 1033 supply the first reference voltage Vref1 to the sub-pixels R1, W1, G1, B1, R3, W3, G3, B3 of the ODD pixel in each of the pixel lines L1 and L2. For example, the first-first branch line 1032 is connected to the sub-pixels R1, W1, G1, and B1 of the first ODD pixel disposed in the first pixel line L1 to supply the first reference voltage Vref1 to the sub-pixels R1, W1, G1, and B1). The first-second branch line 1033 is connected to the sub-pixels R3, W3, G3, and B3 of the second ODD pixel disposed in the second pixel line L2 to supply the first reference voltage Vref1 to the sub-pixels R3, W3, G3, and B3.

The second sensing line 1034 supplies a second reference voltage Vref2 to the EVEN pixels in each of the pixel lines L1 and L2. The second sensing line 1034 is connected to the second branch lines 1035 and 1036. The second branch lines 1035 and 1036 may be implemented with a long pattern in a direction parallel to the gate lines 1041 and 1042 (x-axis direction). The second branch lines 1035 and 1036 supply the second reference voltages Vref2 to the sub-pixels R2, W2, G2, B2, R4, W4, G4, B4 of the EVEN pixel in each of the pixel lines L1 and L2. For example, the second-first branch line 1035 is connected to the sub-pixels R2, W2, G2, and B2 of the first EVEN pixel disposed on the first pixel line L1 to supply the second reference voltage Vref2 to the sub-pixels R2, W2, G2 and B2. The second-second branch line 1036 is connected to the sub-pixels R4, W4, G4, and B4 of the second EVEN pixel disposed in the second pixel line L2 to supply the second reference voltage Vref2 to the sub-pixels R4, W4, G4 and B4.

The first branch lines 1032 and 1033 and the second branch lines 1035 and 1036 may be separated between the ODD pixel and the EVEN pixel such that the ODD pixel and the EVEN pixel may be sensed independently. The first reference voltage Vref1 and the second reference voltage Vref2 may be set to the same voltage.

In the sensing mode, one of the sub-pixels of the same color in the ODD pixel and the EVEN pixel is applied with a black gradation voltage to write the Black value, and the other is applied with a sensing data voltage to write a Valid value. The present disclosure may sense the operating point of the light emitting element OLED from which common noise is removed by subtracting the Valid value and Black value sensed from the sub-pixel to which the black gradation voltage is applied and the sub-pixel to which the sensing data voltage is applied.

An example of the ODD pixel ODD PXL and the EVEN pixel EVEN PXL compared in the sensing mode will be described as an example with respect to the first pixel PXL1 and the second pixel PXL2. Hereinafter, the first pixel PXL1 and the second pixel PXL2 are explained as the sub-pixels of the same color in each of the first pixel PXL1 and the second pixel PXL2, for example, the R sub-pixels R1 and R2.

FIG. 3 is a view showing a driving voltage generation unit and a sensing unit of the source drive IC according to an embodiment of the present disclosure. In FIG. 3, R represents an R sub-pixel as an example of a sub-pixel. FIG. 4 is an equivalent circuit diagram showing the pixel circuit of the sub-pixel shown in FIG. 3 according to an embodiment of the present disclosure.

Referring to FIGS. 3 and 4, the source drive IC (SIC) may include a driving voltage generation unit 112 and a sensing unit 111.

The sensing unit 111 uses a correlation double sampling (CDS) method of simultaneously sampling a valid value written in one of two neighboring pixels and a black value written in another pixel to remove common noise components of pixels.

The sensing line 103 is selectively connected to the driving voltage generation unit 112 and the sensing unit 111 through switch elements SX1 and SX2. The driving voltage generation unit 112 may include a first driving voltage generation unit that generates a data voltage Vdata and a second driving voltage generation unit that generates a reference voltage Vref.

The first driving voltage generation unit may include a first DAC DAC1. The first DAC DAC1 converts pixel data of an input image to a data voltage Vdata in a display mode. The first DAC DAC1 converts the sensing data VALID and black gradation data BLACK into a voltage to be applied to the pixels in a sensing mode. The sensing data VALID is converted to a sensing data voltage. The black gradation data BLACK is converted into a black gradation voltage. The second DAC DAC2 converts the reference voltage data to the reference voltage Vref.

The data voltage Vdata is applied to the gate of the driving element DT in each of the sub-pixels R. The reference voltage Vref is applied to the source of the driving element DT in the display driving mode. In the sensing mode, a reference voltage Vref-CI of an integrator (CI in FIG. 5) may be supplied to the source of the driving element DT of the sub-pixel R to be sensed. The reference voltage Vref-CI and the reference voltage Vref of the integrator CI are used to program the gate-source voltage Vgs of the driving element DT in the sensing mode and the display driving mode, respectively, and may be set to the same level as each other, or may be set to different levels.

The first switch element SX1 is connected between the sensing line 103 and the second DAC DAC2. The second switch element SX2 is connected between the sensing line 103 and the sensing unit 111. The first switch element SX1 and the second switch element SX2 are selectively turned on.

The first switch element SX1 supplies the reference voltage Vref to the pixels PXL in the display driving mode. The second switch element SX2 is turned on in the sensing mode to supply the reference voltage Vref-CI to the pixels PXL and to form a current path between the pixels PXL and the sensing unit 111. Therefore, the sensing line 103 is selectively connected to the second DAC DAC2 and the sensing unit 111 through the first and second switch elements SX1 and SX2.

Referring to FIG. 4, the pixel circuit includes a light emitting element OLED, a driving device DT, pixel switch elements ST1 and ST2, and a storage capacitor Cst. The driving element DT and the pixel switch elements ST1 and ST2 may be implemented with an n-channel transistor NMOS, but are not limited thereto.

The light emitting element OLED emits light with a brightness proportional to the current from the driving element DT. The anode of the light emitting element OLED is connected to a second node N2, and the cathode is connected to the input terminal of the low potential power voltage ELVSS. A capacitor Coled is connected at opposite sides of the light emitting element OLED to charge the anode voltage.

The driving element DT generates a current driving the light emitting element OLED according to the gate-source voltage Vgs. The gate of the driving element DT is connected to the first node N1. A first electrode of the driving element DT is connected to the pixel driving power line 101 to receive a pixel driving voltage ELVDD. A second electrode of the driving element DT is connected to the second node N2.

The pixel switch elements ST1 and ST2 set the gate-source voltage Vgs of the driving element DT, and connect the second electrode of the driving element DT and the sensing line 103.

The first pixel switch element ST1 is connected between the data line 102 and the first node N1 and turned on according to the pulse of the scan signal SCAN from the gate line 104. The first pixel switch element ST1 is turned on in the display driving mode or the sensing driving mode to apply the data voltage Vdata to the gate of the driving element DT. The gate of the first pixel switch element ST1 is connected to the gate line 104. The first electrode of the first pixel switch element ST1 is connected to the data line 102, and the second electrode is connected to the first node N1.

The second pixel switch element ST2 is connected between the sensing line 103 and the second node N2 and turned on according to the scan signal SCAN from the gate line 104. The second pixel switch element ST2 supplies the reference voltage Vref or the reference voltage Vref-CI of the integrator CI to the second node N2 in the display driving mode and the sensing mode. In addition, the second pixel switch element ST2 is turned on in the sensing mode to connect the light emitting element OLED to the sensing line 103 to apply a current flowing in the light emitting element OLED to the sensing line 103. The gate of the second pixel switch element ST2 is connected to the gate line 104. The first electrode of the second pixel switch element ST2 is connected to the sensing line 103, and the second electrode is connected to the second node N2.

The storage capacitor Cst is connected between the first node N1 and the second node N2 to charge the gate-source voltage Vgs of the driving element DT to maintain it for a period of time.

Figure 5:
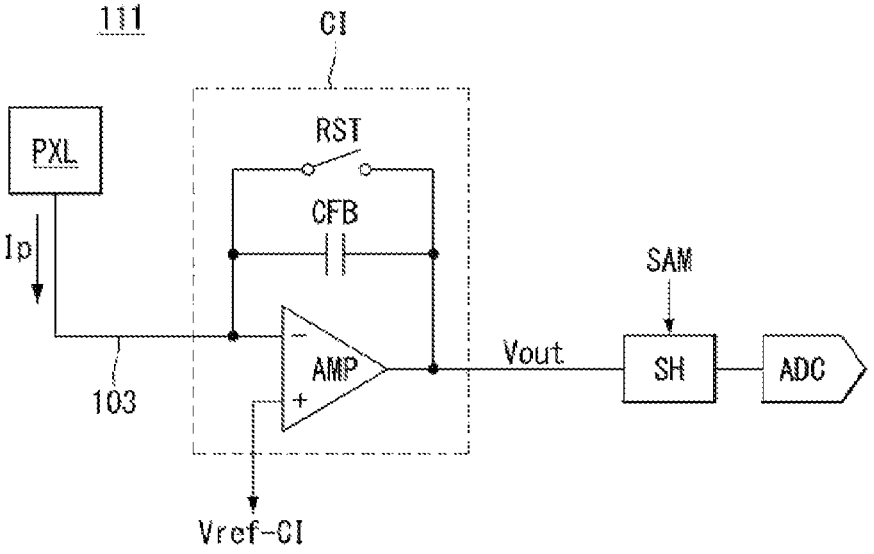
FIG. 5 is a circuit diagram showing an example of a sensing unit in detail according to an embodiment of the present disclosure.

FIG. 5 is a circuit diagram showing an example of a sensing unit in detail according to an embodiment of the present disclosure.

Referring to FIG. 5, the sensing unit 111 may include an integrator (CI), a sample and hold unit SH, and an analog-to-digital converter (hereinafter referred to as ADC).

The integrator CI is connected between the sensing line 103 of the display panel 10 and the sample and hold unit SH, such that a voltage Vout obtained by accumulating electric charges received through the sensing line 103 in the capacitor CFB for a predetermined time is output to the sample and hold unit SH. The integrator CI senses a current Ip flowing through the sensing line 103 after supplying the reference voltage Vref-CI to the pixel PXL through the sensing line 103. A potential difference is generated across the capacitor CFB according to the amount of current and time input to the integrator CI. The integrator CI charges the charges supplied by the input current Ip to the capacitor CFB to generate an output voltage Vout that changes from the reference voltage Vref-CI.

The integrator CI may include an operational amplifier AMP, a capacitor CFB, and a reset switch RST. The operational amplifier AMP includes a first input terminal (−) that receives a current Ip through the sensing line 103, a second input terminal (+) that receives a reference voltage Vref-CI, and an output terminal that outputs an output voltage (Vout) obtained as a result of integration of the current Ip. The capacitor CFB is connected between the first input terminal (−) and the output terminal.

The reset switch RST is connected in parallel with the capacitor CFB between the first input terminal (−) and the output terminal of the operational amplifier AMP. The reset switch RST is turned on when initializing the integrator CI to discharge the capacitor CFB. The reset switch RST remains off in the sensing mode.

The sample and hold unit SH samples the output voltage Vout of the integrator obtained as a result of sensing the current Ip flowing in the sensing line 103. The sample and hold unit SH performs a correlation double sampling to double-sample the valid value and black value sensed from sub-pixels of the same color between the first pixel PXL1 and the second pixel PXL1, and outputs the difference therebetween, such that a voltage indicating an operating point of the light-emitting element OLED from which noise is removed may be output.

The sample and hold unit SH may be implemented with a sampling switch and a sampling capacitor, and a holding switch that operate according to a sampling signal SAM, but is not limited thereto.

Figure 6:
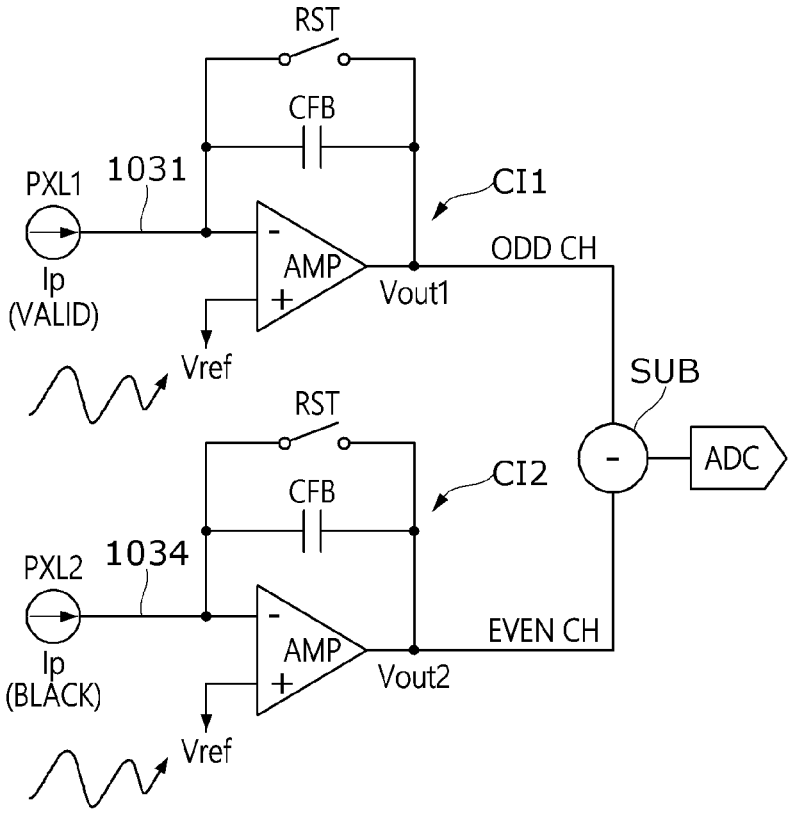
FIGS. 6 and 7 are diagrams for describing a correlation double sampling method and apparatus for removing common noise according to an embodiment of the present disclosure.

The sample and hold unit SH may include a double sampling device. As illustrated in FIG. 6, the double sampling device may include a subtractor SUB that receives output voltages Vout1 and Vout2 of an integrator CI1 of an odd-numbered channel and an integrator CI2 of an even-numbered channel. The sampling switch may be connected to the output terminals of the integrators CI1 and CI2 as shown in FIG. 6. When the sampling switch is turned on, the output voltages Vout1 and Vout2 of the integrators CI1 and CI2 may be input to the sample and hold unit SH.

The ADC converts a sampled sensing voltage to digital data, outputs the ADC data, and transmits it to the timing controller 130.

Figure 7:
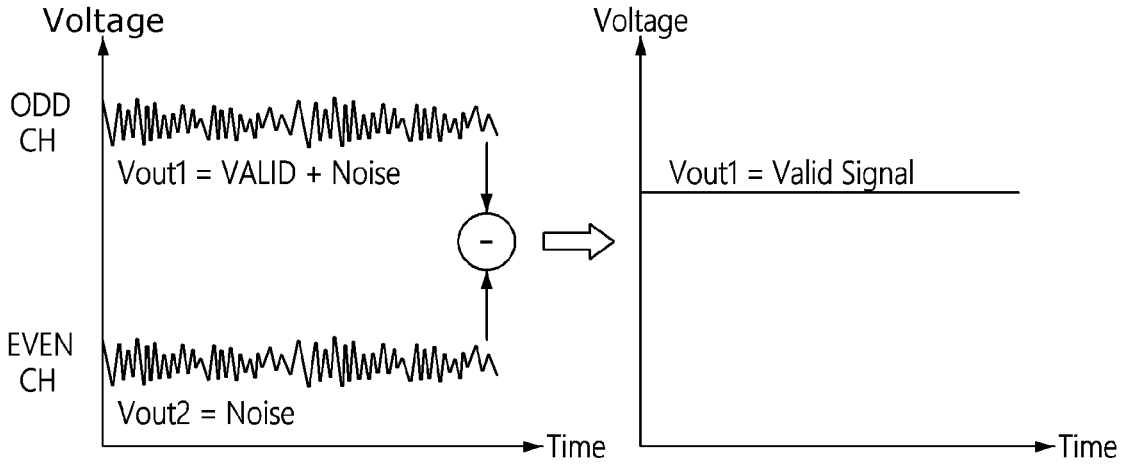

Referring to FIGS. 6 and 7 are diagrams for describing a correlation double sampling method for removing common noise. In FIG. 6, "Valid Current" is a current Ip flowing in the first sensing line 1031 when a valid value is written in the first pixel PXL1. A current Ip flows in the second sensing line 1034 when a Black value is written in the second pixel PXL2.

FIGS. 6 and 7, when the difference between the Valid value of the first pixel PXL1 and the Black value of the second pixel PXL2 is obtained, the operating point of the light emitting element OLED of the first pixel PXL1 from which noise is removed may be sensed.

The first integrator CI1 is connected between the first sensing line 1031 and the odd-numbered channel (hereinafter referred to as ODD CH) to integrate the current flowing through the light emitting element OLED of the first pixel PXL1, such that the first output voltage Vout1 is generated. The first output voltage Vout1 is a voltage obtained by adding a voltage of sensing data VALID and a voltage of common noise.

The second integrator CI2 is connected between the second sensing line 1034 and the even numbered channel (hereinafter referred to as EVEN CH) to integrate the current flowing through the light emitting element OLED of the second pixel PXL2, such that a second output voltage Vout2 is generated. The second output voltage Vout2 includes a voltage of common noise.

The subtractor SUB outputs a subtraction result of the first output voltage Vout1 and the second output voltage Vout2 input through the ODD CH and EVEN CH. The voltage of the subtractor SUB is input to the ADC.

Conversely, when the difference between the Valid value of the second pixel PXL2 and the Black value of the first pixel PXL1 is obtained, the operating point of the light emitting element OLED of the second pixel PXL2 from which noise is removed may be sensed. In this case, the Black value is written in the first pixel PXL1, and the Valid value is written in the second pixel PXL2.

Figure 8:
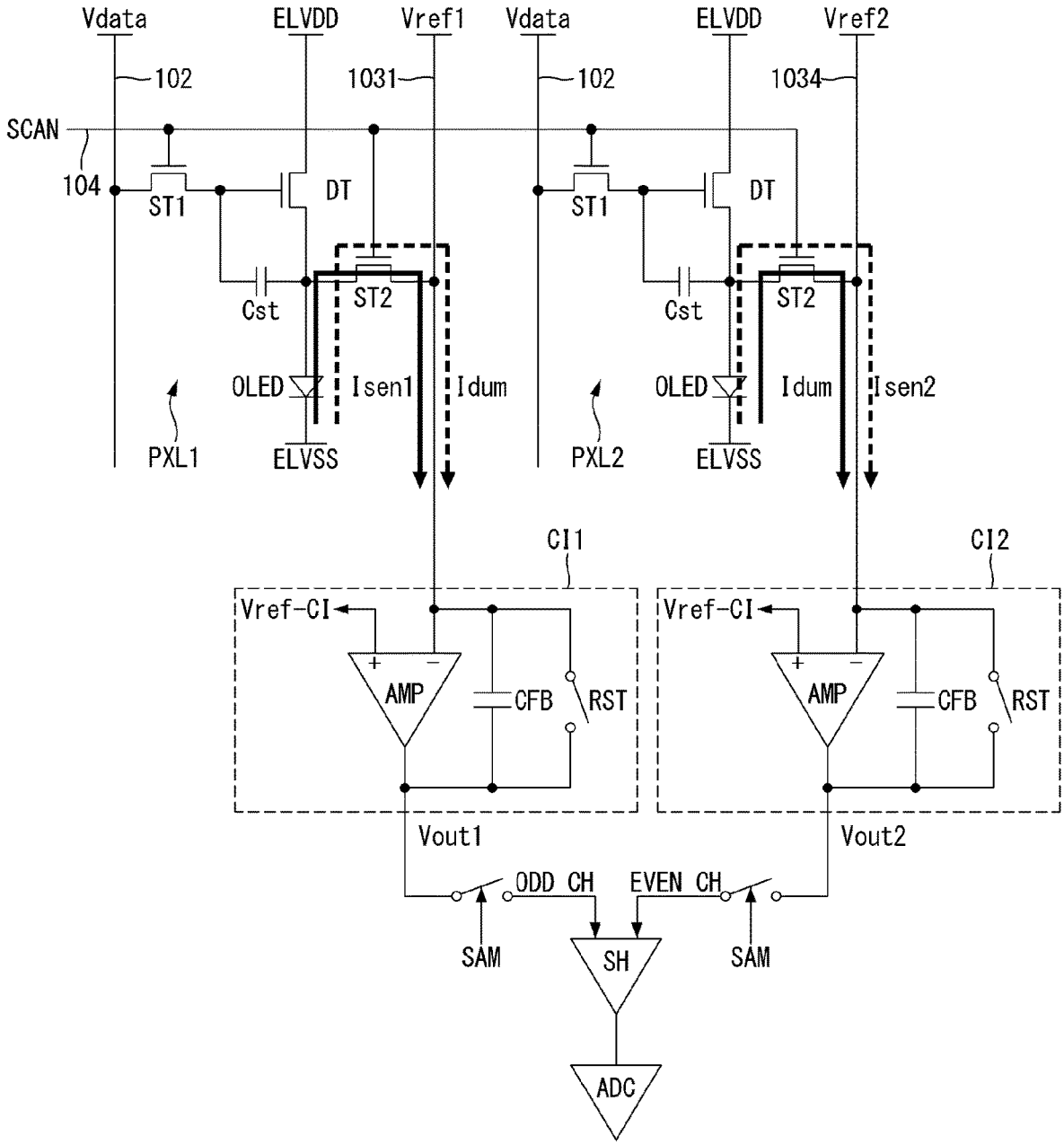
FIG. 8 is a circuit diagram showing first and second pixels and a sensing unit in detail according to an embodiment of the present disclosure.

FIG. 8 is a circuit diagram showing the first and second pixels PXL1 and PXL2 and the sensing unit in detail according to an embodiment of the present disclosure.

Referring to FIG. 8, ODD CH includes odd-numbered pixels including a first pixel PXL1, a first sensing line 1031 connected to the pixels, and a first integrator CH. EVEN CH includes even-numbered pixels including a second pixel PXL2, a second sensing line 1034 connected to the pixels, and a second integrator CI2.

The sensing mode may be divided into a first sensing step for sensing electrical characteristics of the first pixel PXL1 by removing noise from a Valid value of the first pixel PXL1 and a second sensing step for sensing the electrical characteristics of the second pixel PXL2 by removing noise from a Valid value of the second pixel PXL2. In FIG. 8, the solid line represents currents flowing through the pixels PXL1 and PXL2 and the sensing lines 1031 and 1034 in the first sensing step. The dotted line represents currents flowing through the pixels PXL1 and PXL2 and the sensing lines 1031 and 1034 in the second sensing step.

In the first sensing step, the Valid value is written in the first pixel PXL1 and at the same time, the Black value is written in the second pixel PXL2. In this case, a current Isen1 corresponding to the Valid value flows into the first sensing line 1031, and a common noise current Idum flows into the second sensing line 1034. The first integrator CI1 integrates the current Isen1 from the first pixel PXL1 during the first sensing step, and the second integrator CI2 integrates the common noise current Idum from the second pixel PXL2.

In the first sensing step, the sample and hold unit SH outputs a voltage obtained by subtracting the output voltage Vout2 of the second integrator CI2 from the output voltage Vout1 of the first integrator CI1.

In the second sensing step, the Valid value is written in the second pixel PXL2 and at the same time, the Black value is written in the first pixel PXL1. In this case, a current Isen2 corresponding to the Valid value flows into the second sensing line 1034, and a common noise current Idum flows into the first sensing line 1031. The second integrator CI2 integrates the current Isen2 from the second pixel PXL2 during the second sensing step, and the first integrator CI1 integrates the common noise current Idum from the first pixel PXL2.

In the second sensing step, the sample and hold unit SH outputs, to ADC, a voltage obtained by subtracting the output voltage Vout1 of the first integrator CI1 from the output voltage Vout2 of the second integrator CI2.

Figure 11:
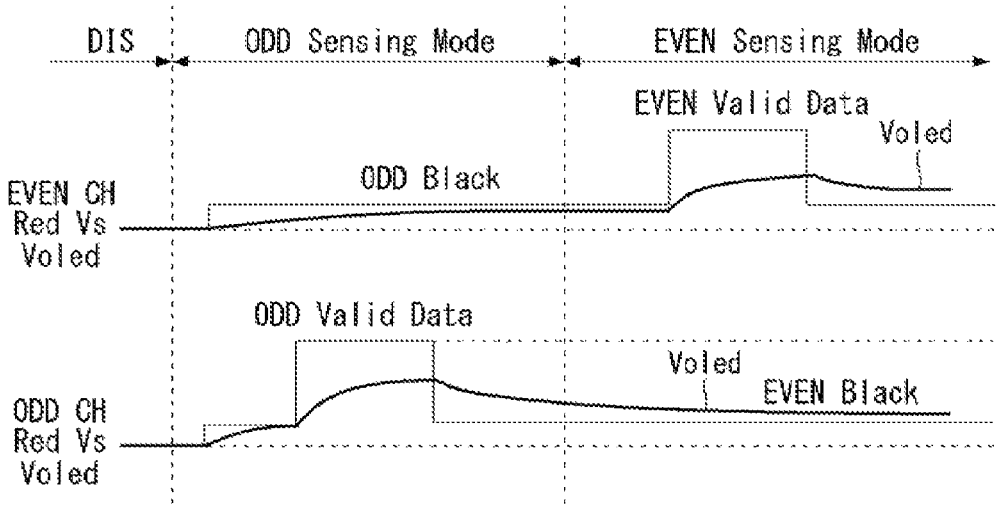

Meanwhile, a difference may occur in the sensing result of the Black value between the first and second pixels PXL1 and PXL2 according to a pixel state before the sensing mode. In this case, as illustrated in FIG. 11, since a difference in noise removed between the first and second pixels PXL1 and PXL2 occurs, it may be difficult to accurately compensate for a change in the operating point of the light emitting element OLED. In FIG. 11, "EVEN/ODD CH Red" is a voltage of the R sub-pixel sensed from the EVEN/ODD CH. "Voled" is the anode voltage charged in the capacitor Coled of the light emitting element OLED.

Figure 9:
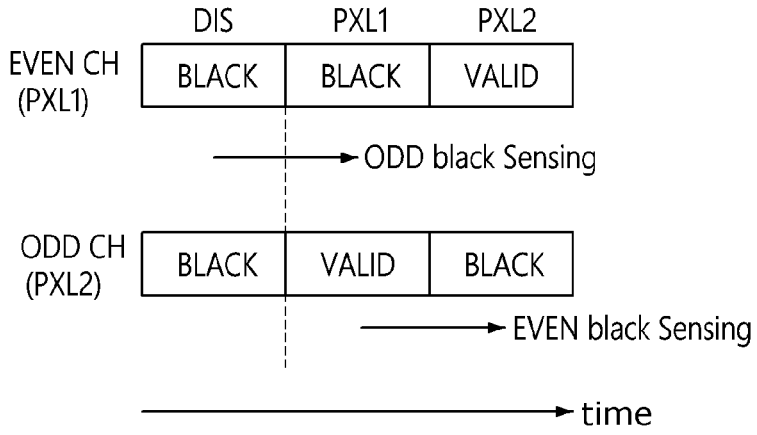
FIGS. 9 to 11 are diagrams illustrating an example in which a difference between sensing results of an odd-numbered pixel and an even-numbered pixel occurs depending on a difference in a pixel state before a sensing mode according to an embodiment of the present disclosure.
Figure 10:
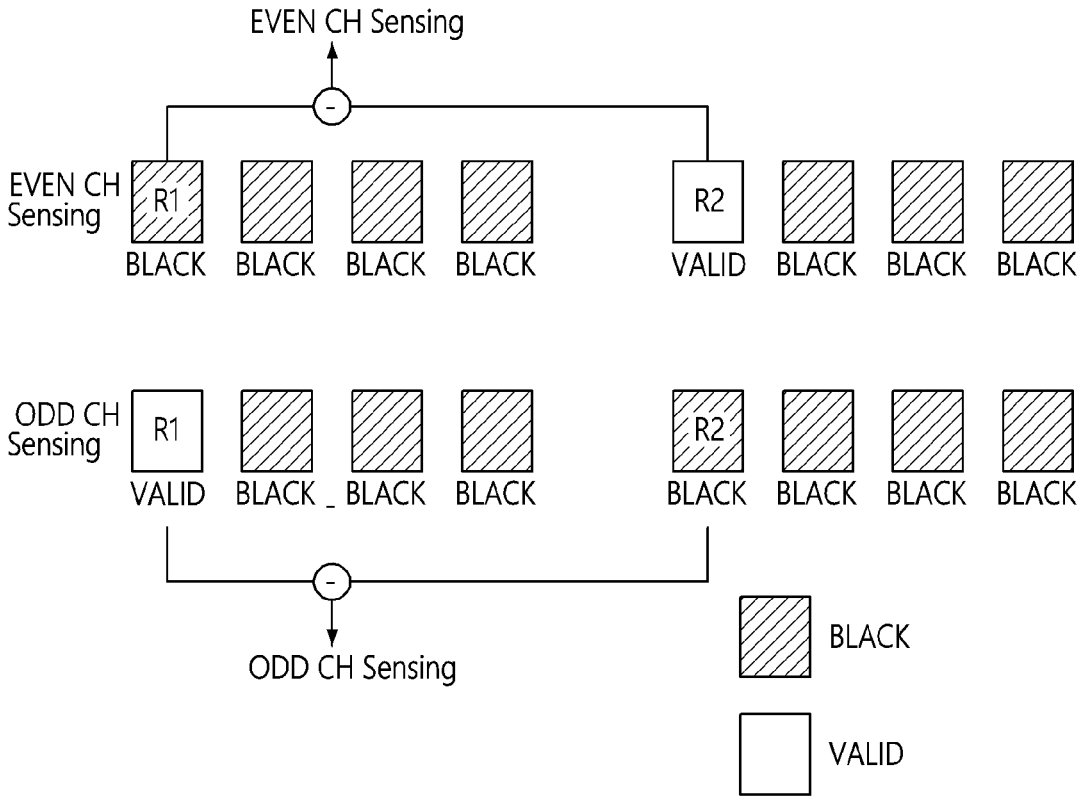

As shown in FIGS. 9 to 11, it is assumed that the Black value are written in all of the first and second pixels PXL1 and PXL2 in the last frame period of a display driving mode DIS. In this case, the sensing value for the Black value may be different in the first sensing step (ODD Sensing Mode) and the second sensing step (EVEN Sensing Mode).

Referring to FIGS. 9 to 11, immediately after the display driving mode DIS, the sensing mode is entered, such that the pixels PXL1 and PXL2 may be driven by the second sensing step (EVEN Sensing Mode) subsequent to the first sensing step (ODD Sensing Mode).

In the first sensing step (ODD Sensing Mode), the Valid value of the first pixel PXL1 and the Black value of the second pixel PXL2 (ODD Black) are sensed. In this case, the voltage of the second pixel PXL2 is changed from the sensing data voltage lower than the black gradation voltage to the black gradation voltage. On the other hand, in the second sensing step (EVEN Sensing Mode), the Valid value of the second pixel PXL2 and the Black value of the first pixel PXL1 (EVEN Black) are sensed. In this case, the voltage of the first pixel PXL1 is changed from the sensing data voltage higher than the black gradation voltage to a black gradation voltage. Accordingly, the Black value (ODD Black) of the second pixel PXL2 sensed in the first sensing step (ODD Sensing Mode) may be different from the Black value (EVEN Black) of the first pixel PXL1 sensed in the first sensing step (ODD Sensing Mode). As a result, the result of the Valid value—the Black value in the first and second pixels PXL1 and PXL2 may be different.

Figure 12:
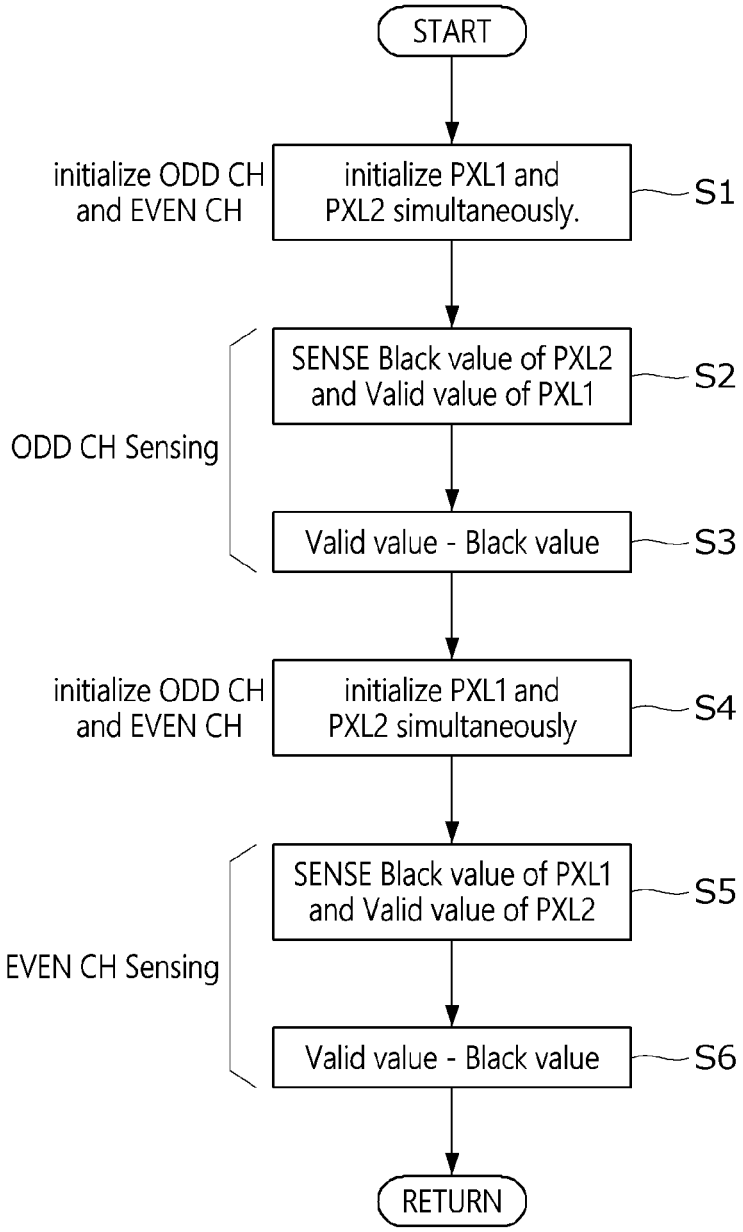
FIG. 12 is a flowchart illustrating a control procedure of a correlation double sampling method according to an embodiment of the present disclosure.

FIG. 12 is a flowchart illustrating a control procedure of a correlation double sampling method according to an embodiment of the present disclosure.

Referring to FIG. 12, according to the present disclosure, a first initialization step may be set after the display driving mode DIS is finished. In the first initialization step, before entering the sensing mode, Black values are written to the first and second pixels PXL1 and PXL2 to initialize the pixels PXL1 and PXL2 simultaneously with the Black values (S1). The step S1 may be performed one or more times. In the first initialization step, the integrators CI1 and CI2 of the ODD CH and EVEN channels may be initialized. In the first initialization step, the output voltages Vout1 and Vout2 of the integrators CI1 and CI2 may be maintained as black gradation voltages.

Subsequently, according to the present disclosure, in the first sensing step (ODD Sensing Mode), a Valid value is written in the first pixel PXL1, a Black value is written in the second pixel PXL2, and the operating point of the light emitting element OLED of the first pixel PXL1 from which common noise is removed as a result of subtracting the Black value from the Valid value is sensed (in steps S2 and S3). In the second step, the first integrator CH outputs an operating point voltage of the light emitting element OLED in which the common noise is reflected. At the same time, the second integrator CI2 outputs a black gradation voltage in which common noise is reflected.

The steps S2 and S3 may be performed one or more times consecutively. In addition, the step S3 may be performed after the step S2 is performed one or more times. The second and third steps S2 and S3 are operating point sensing steps of the first pixel PXL1 sensed through the ODD CH.

Before entering the second sensing step (EVEN Sensing Mode), a second initialization step is set. In the second initialization step, the Black values are written to the first and second pixels PXL1 and PXL2, and the pixels PXL1 and PXL2 are simultaneously initialized to a black value (in step S4). The step S4 may be performed one or more times. In the second initialization step, the integrators CI1 and CI2 of the ODD CH and EVEN channels may be initialized. In the second initialization step, the output voltages Vout1 and Vout2 of the integrators CI1 and CI2 may be maintained as black gradation voltages.

Subsequently, according to the present disclosure, in the second sensing step (EVEN Sensing Mode), a Valid value is written in the second pixel PXL2, a Black value is written in the first pixel PXL1, and the operating point of the light emitting element OLED of the second pixel PXL2 from which common noise is removed as a result of subtracting the Black value from the Valid value is sensed (in steps S5 and S6). In the fifth step, the second integrator CI2 outputs an operating point voltage of the light emitting element OLED in which common noise is reflected. At the same time, the first integrator CI1 outputs a black gradation voltage in which common noise is reflected.

The steps S5 and S6 may be performed one or more times consecutively. In addition, the step S4 may be performed after the step S5 is performed one or more times. The fifth and sixth steps S5 and S6 sense an operating point of the second pixel PXL2 sensed through the EVEN CH.

The steps S1 to S6 may be continuously performed for sub-pixels of all colors. For example, the steps S1 to S6 may be sequentially performed in the order of R sub-pixel, W sub-pixel, G sub-pixel, and B sub-pixel.

Figure 13:
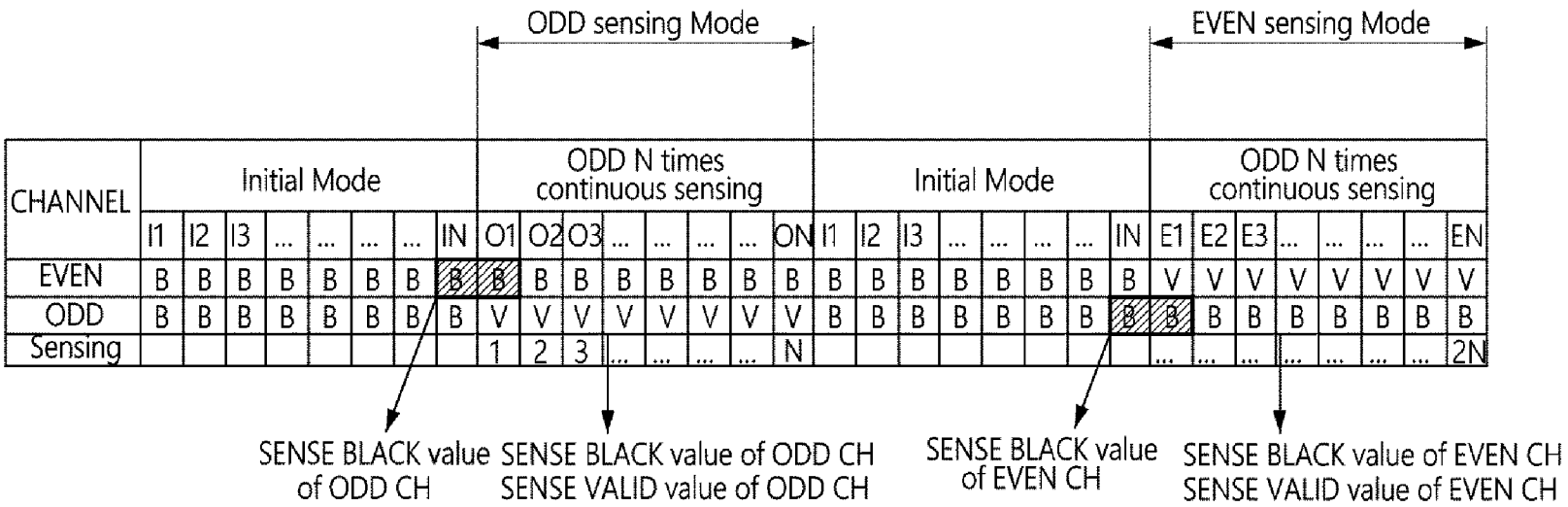

FIGS. 13 and 14 are diagrams showing an example in which an initialization step and a sensing step are continuously performed. In FIG. 13, "I1 to IN" are the number of consecutive times of the initialization step. "O1 to ON" are the number of consecutive times of ODD CH. "E1 to EN" are the number of consecutive times of EVEN CH.

Referring to FIGS. 13 and 14, a first initialization step (Initial Mode) may be continuously performed N times (N is a natural number of two or more) in ODD CHs and EVEN CHs, respectively. For example, the first initialization step (Initial Mode) may be repeatedly performed N times consecutively for all pixels, but is not limited thereto.

A first sensing step (ODD Sensing Mode) may be repeatedly performed N times in ODD CHs.

In the first sensing step (ODD Sensing Mode), as shown in FIG. 14, after the odd numbered pixels connected to ODD CHs in the first pixel line L1 are repeatedly executed N times, the odd-numbered pixels connected to ODD CHs in the first pixel line L1 may be repeatedly executed N times again after one or more initialization steps (initial Mode).

The first initialization step (Initial Mode) may be set between the first sensing step (ODD Sensing Mode) and the second sensing step (EVEN Sensing Mode). A second initialization step (Initial Mode) may be performed N times in each of the ODD CHs and EVEN CHs. For example, the second initialization step (Initial Mode) may be performed N times consecutively for all pixels, but is not limited thereto.

A second sensing step (EVEN Sensing Mode) may be repeatedly performed N times in EVEN CHs.

In the second sensing step (EVEN Sensing Mode), as shown in FIG. 14, following the initialization step (Initial Mode), after the even numbered pixels connected to EVEN CHs in the second pixel line L2 are repeatedly executed N times, the even-numbered pixels connected to EVEN CHs in the second pixel line L2 may be repeatedly executed N times again after one or more initialization steps (Initial Mode).

As illustrated in FIG. 13, the even-numbered pixels before sensing the Black value of the ODD CH sensed in the first sensing step (ODD Sensing Mode) are initialized to the Black value. Similarly, the odd-numbered pixels before sensing the Black value of EVEN CH sensed in the second sensing step (EVEN Sensing Mode) are initialized to the Black value. Therefore, since states before sensing the pixels where the Black value of EVEN CH is sensed and the pixels where the Black value of ODD CH is sensed are the same, the Black value of EVEN CH and the Black value of ODD CH may be substantially the same. As a result, according to the present disclosure, it is possible to minimize or reduce errors in sensing results for electrical characteristics of the odd-numbered pixels and even-numbered pixels.

Figure 15:
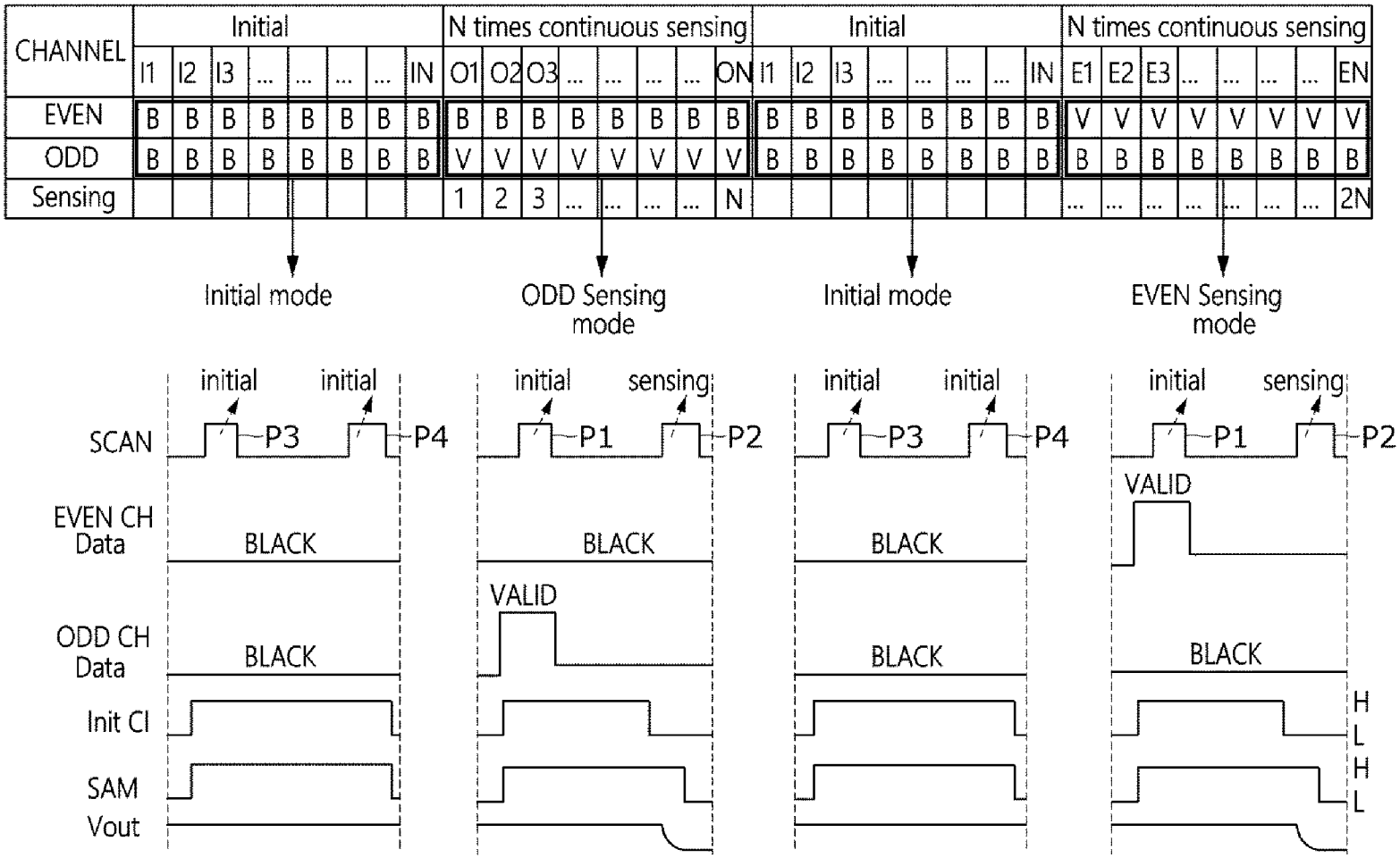
FIG. 15 is a diagram illustrating a method of driving pixels and a double sampling device in an initialization step and a sensing step according to an embodiment of the present disclosure.
Figure 17:
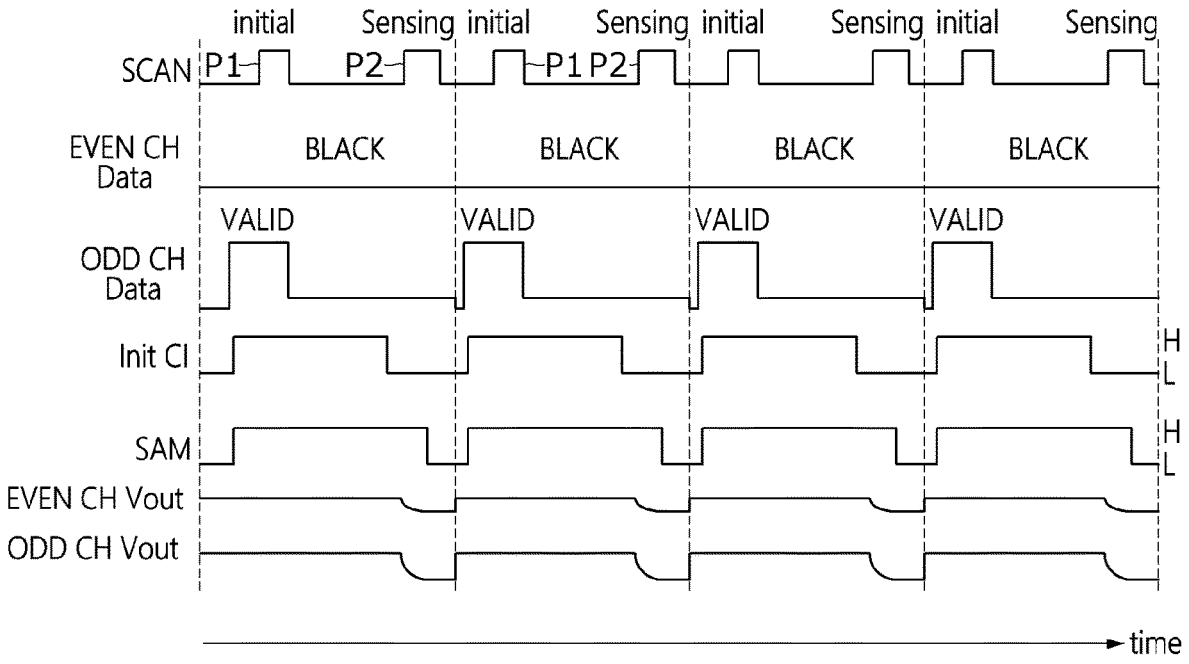
FIG. 17 is a waveform diagram showing a method of driving pixels and a double sampling device when a first sensing step is continuously performed according to an embodiment of the present disclosure.
Figure 18:
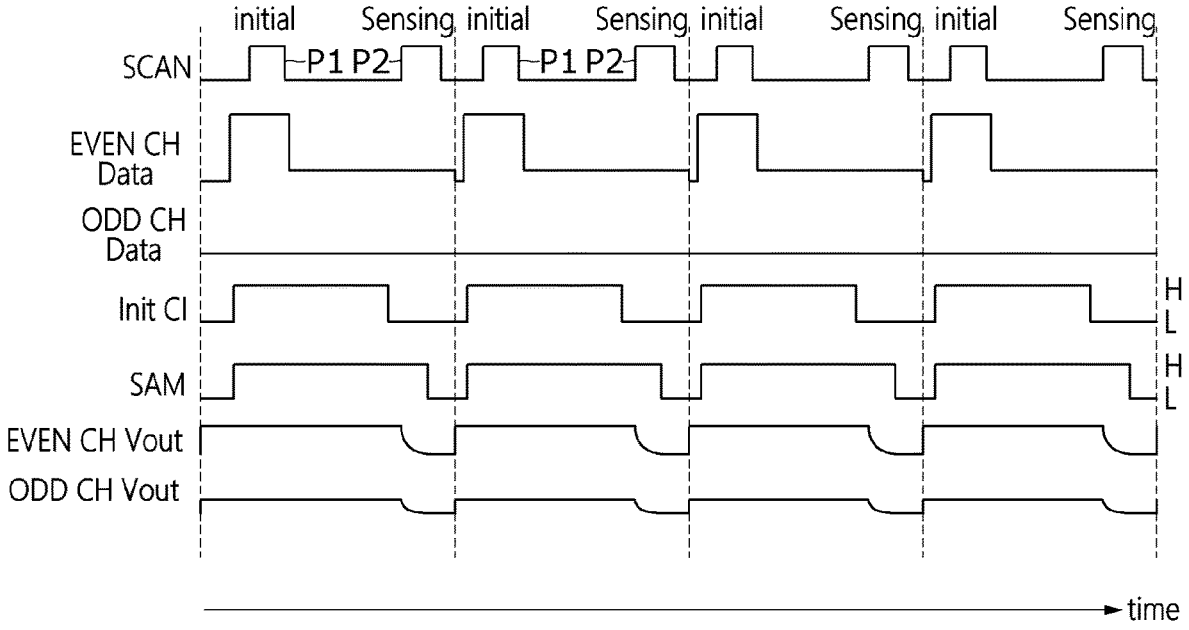
FIG. 18 is a waveform diagram illustrating a method of driving pixels and a double sampling device when a second sensing step is continuously performed according to an embodiment of the present disclosure.

FIG. 15 is a diagram showing a method for driving pixels and a double sampling device in an initialization step and a sensing step according to an embodiment of the present disclosure. FIG. 16 is a waveform diagram showing a method for driving pixels and a double sampling device when the initialization step is continuously performed according to an embodiment of the present disclosure. FIG. 17 is a waveform diagram showing a method for driving pixels and a double sampling device when the first sensing step is continuously performed according to an embodiment of the present disclosure. FIG. 18 is a waveform diagram showing a method for driving pixels and a double sampling device when the second sensing step is continuously performed according to an embodiment of the present disclosure.

Referring to FIGS. 15 to 18, pulses P1 and P2 of scan signals SCAN are continuously supplied to pixel lines in the sensing step (ODD Sensing Mode, EVEN Sensing Mode). After a predetermined time has elapsed subsequent to the first pulse P1, the second pulse P2 is commonly applied to pixels of one pixel line through the gate line 104. The first pulse P1 is synchronized with a sensing data voltage Valid or black gradation voltage Black supplied to the pixels. In the pixel to which the first pulse P1 is applied, the anode voltage of the light emitting element OLED is initialized to be equal to or higher than the operating point voltage or threshold voltage of the light emitting element OLED. When the second pulse P2 is generated, a current of the pixel is input to the integrators CI1 and CI2 of the double sampling device through the sensing lines 1031 and 1034. When the second pulse P2 is generated, a current is input to the first integrator CI1 through the first sensing line 1031, and a current is input to the second integrator CI2 through the second sensing line 1034.

In the first sensing step (ODD Sensing Mode), the Valid value synchronized to the first pulse P1 is written in the odd-numbered pixels connected to the ODD CH, and the Black value is written in the even-numbered pixels connected to the EVEN CH. In the second sensing step (EVEN Sensing Mode), the Valid value is written in the even-numbered pixels connected to the EVEN CH, and the Black value is written in the even-numbered pixels connected to the ODD CH.

Figure 16A:
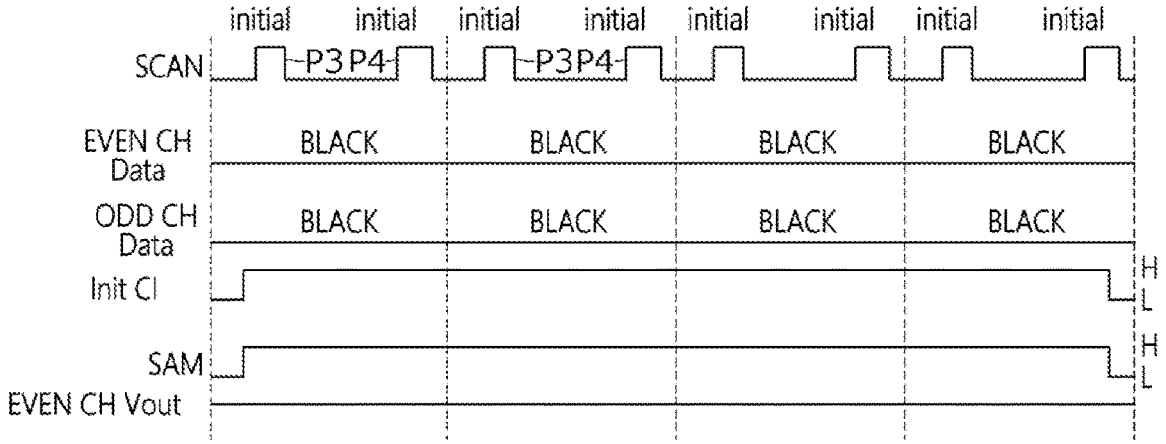
FIGS. 16A and 16B are waveform diagrams illustrating a method of driving pixels and a double sampling device when an initialization step is continuously performed according to an embodiment of the present disclosure.
Figure 16B:
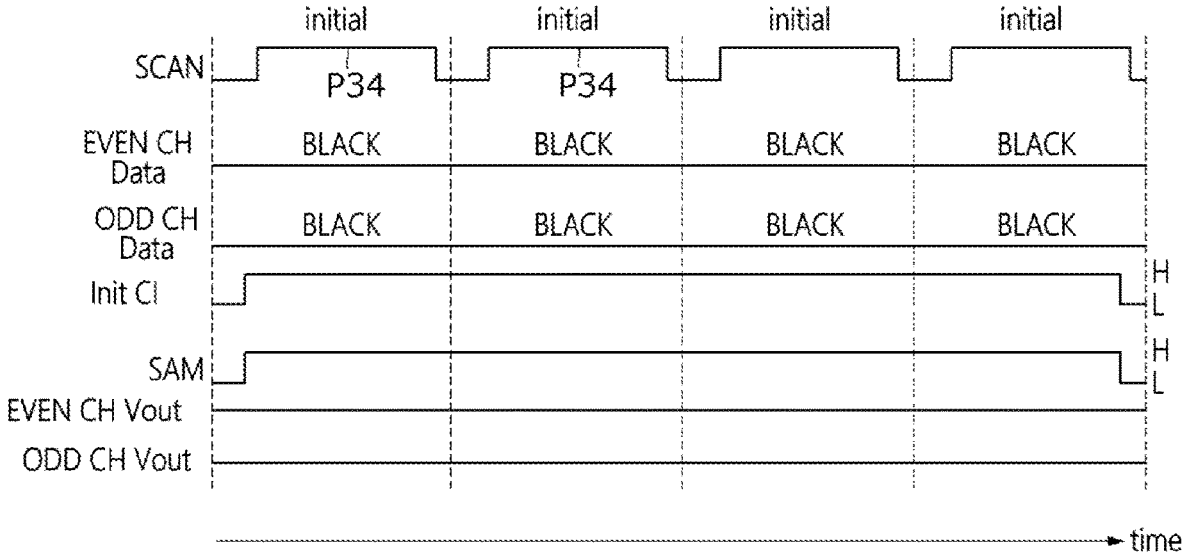

In the initialization step (Initial Mode), the pulses P3 and P4 of the scan signals SCAN may be continuously supplied to the pixel lines as shown in FIG. 16A. After a predetermined time has elapsed subsequent to the third pulse P3, the fourth pulse P4 is commonly applied to pixels of one pixel line through the gate line 104. The first pulse P1 is synchronized with a sensing data VALID or black gradation data BLACK. In the pixel to which the first pulse P1 is applied, the anode voltage of the light emitting element OLED is initialized to be equal to or higher than the operating point voltage or threshold voltage of the light emitting element OLED. When the second pulse P2 is generated, a current of the pixel is input to the integrator of the double sampling device through the sensing lines 1031 and 1034. As another example, a third pulse P34 having a large pulse width may be supplied to the pixel line in the initialization step (Initial Mode) as shown in FIG. 16B. In this case, the third pulse P34 may be set to a wider pulse width than each of the first and second pulses P1 and P2.

In the first sensing step (ODD Sensing Mode), the Valid value synchronized to the first pulse P1 is written in the odd-numbered pixels connected to the ODD CH, and the Black value is written in the even-numbered pixels connected to the EVEN CH. In the second sensing step (EVEN Sensing Mode), the Valid value is written in the even-numbered pixels connected to the EVEN CH, and the Black value is written in the odd-numbered pixels connected to the ODD CH.

The integrators CI1 and CI2 are initialized by an Init CI signal. The Init CI signal may be generated in the timing controller 130. When the Init CI signal is a high logic H, a reset switch RST is turned on to discharge a capacitor CFB. In this case, the integrators CI1 and CI2 are initialized.

In the initialization step (Initial Mode), the Init CI signal maintains a high logic section H, such that the integrators CI1 and CI2 may maintain the initialization state. In the initialization step (Initial Mode), a sampling signal SAM maintains a high logic section H, so that the output terminals of the integrators CI1 and CI2 may be connected to the ADC through the sample and hold unit SH.

In the first and second sensing steps (ODD/EVEN Sensing Mode), the high logic section H of the Init CI signal becomes short and the low logic section becomes long. In the logic section L of the Init CI signal, the reset switch RST is turned off so that the integrators CI1 and CI2 accumulate the input currents and output the accumulated voltage. When the output voltages Vout of the integrators CI1 and CI2 are lowered, the operating point or threshold voltage of the light emitting element OLED is sensed. In the sampling step (ODD/EVEN Sensing Mode), the sampling signal SAM maintains a high logic section H so that the output terminals of the integrators CI1 and CI2 may be connected to the ADC through the sample and hold unit SH.

Figure 19:
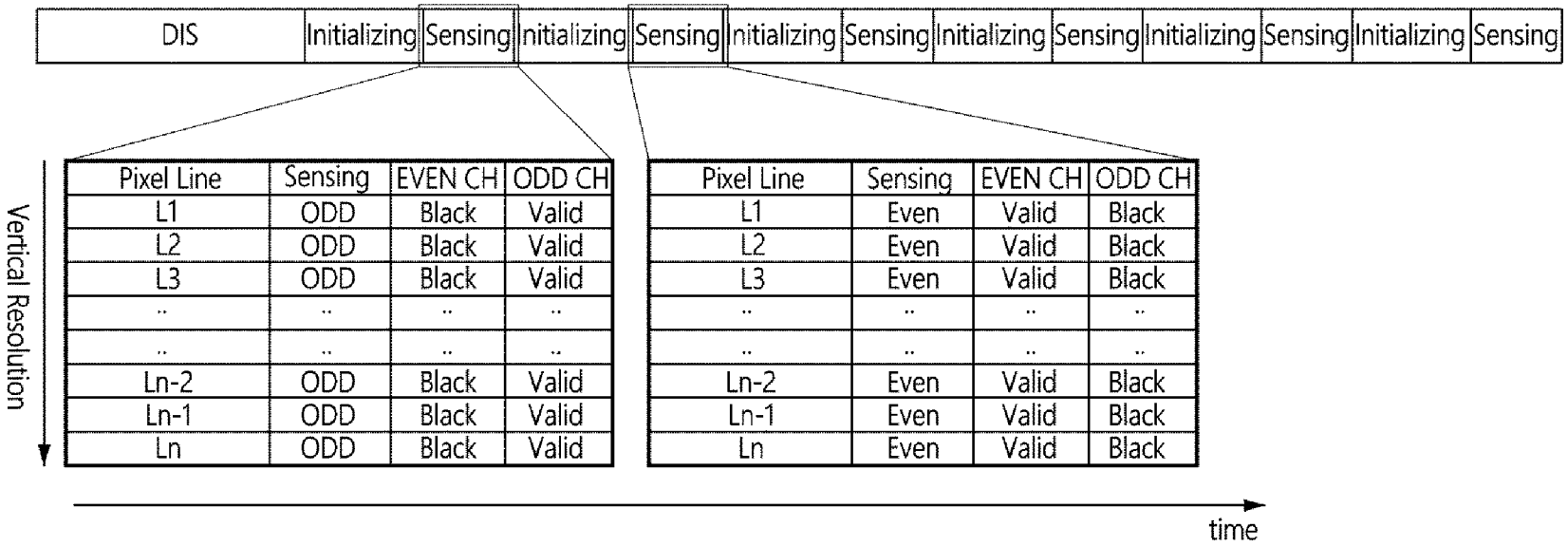

FIGS. 19 and 20 are diagrams illustrating an example in which electrical characteristics of all odd-numbered pixels in the pixel array are sensed in the first sensing step, and electrical characteristics of all even-numbered pixels in the pixel array are sensed in the second sensing step.

Referring to FIGS. 19 and 20, in the first sensing step (ODD Sensing Mode), the electrical characteristics of the odd-numbered pixels connected to the ODD CH in all the pixel lines L1 to Ln may be sensed during an odd-numbered sensing frame period (hereinafter referred to as "a first sensing frame period").

In the second sensing step (EVEN Sensing Mode), the electrical characteristics of the even-numbered pixels connected to EVEN CH in all the pixel lines L1 to Ln may be sensed during the even-numbered sensing frame period (hereinafter referred to as "a second sensing frame period").

As illustrated in FIG. 20, the above-described initialization step (Initial Mode) may be set before each of the first and second sensing steps (ODD/EVEN Sensing Mode).

Figure 21:
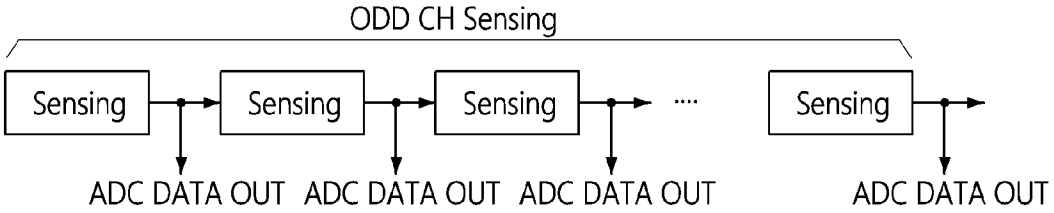
FIGS. 21 to 23 are diagrams showing output timing of ADC data when a sensing step is continuously performed according to an embodiment of the present disclosure.
Figure 22:
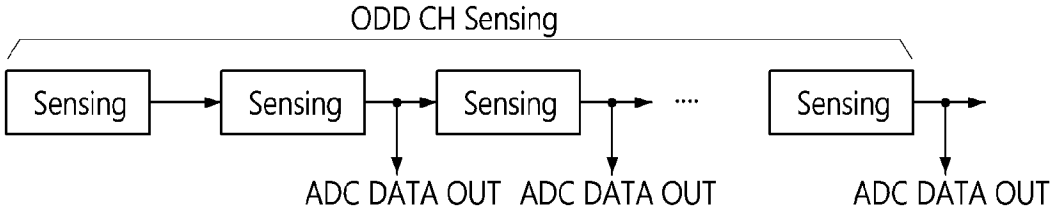
Figure 23:
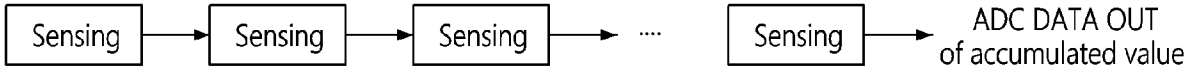

FIGS. 21 to 23 are diagrams showing output timing of ADC data when the sensing step is continuously performed according to an embodiment of the present disclosure.

As illustrated in FIG. 21, when the first and second sensing steps (ODD/EVEN Sensing Mode) are continuous, the ADC data including sensing result information may be output for each sensing step. The sum of the ADC data continuously output may be transmitted to the compensation unit 132.

The sensing result obtained in the initial sensing step may be ignored because it may be inaccurate. In consideration of this, as illustrated in FIG. 22, the initial sensing result is ignored and then the ADC data may be generated for subsequent sensing results.

In another embodiment, the double sampling device may output the ADC data after accumulating consecutive sensing results.

Various embodiments for the display device of the present disclosure is summarized as follows:

In one embodiment, a display device comprises a display panel including data lines, sensing lines, and first and second pixels, each of which includes a plurality of sub-pixels having different colors; a data driving unit converting pixel data of an input image into a data voltage to supply a converted data voltage to the data lines in a display driving mode, and converting sensing data and black gradation data BLACK into a black gradation voltage to supply the black gradation voltage to the data lines in the sensing mode; a gate driving unit supplying a gate signal to the pixels of the display panel; and a double sampling device sensing electrical characteristics of the first and second sub-pixels in the sensing mode.

The sensing mode includes: a first sensing step in which the electrical characteristic of the first sub-pixel is sensed, a first initialization step set in advance of the first sensing step, a second sensing step in which the electrical characteristic of the second sub-pixel is sensed, and a second initialization step set in advance of the second sensing step.

In the first initialization step, a black gradation voltage corresponding to the black gradation data is supplied to the first and second sub pixels. In the first sensing step, a sensing data voltage corresponding to the sensing data is supplied to the first sub-pixel, and the black gradation voltage is supplied to the second sub-pixel so that the electrical characteristic of the first sub-pixel is sensed as a result of subtraction of the sensing data voltage and the black gradation voltage.

In the second initialization step, the black gradation voltage corresponding to the black gradation data is supplied to the first and second sub pixels, and in the second sensing step, the sensing data voltage is supplied to the second sub-pixel, and the black gradation voltage is supplied to the first sub-pixel so that the electrical characteristic of the second sub-pixel is sensed as a result of subtraction of the sensing data voltage and the black gradation.

In one embodiment, the first sub-pixel and the second sub-pixel are sub-pixels of the same color, and are separated by one or more sub-pixels of different colors between them.

In one embodiment, the first and second sub-pixels are adjacent to each other,

In one embodiment, each of the first and second sub-pixels includes a light emitting element.

The electrical characteristics of the first and second sub-pixels are an operating point voltage or a threshold voltage of the light emitting element and a capacitance of the light emitting element.

In one embodiment, each of the first and second initialization steps is continuously performed one or more times.

In one embodiment, each of the first and second sensing steps is continuously performed one or more times.

In one embodiment, the display device further comprises: a first sensing line connected to the first pixel to supply a first reference voltage to sub-pixels of the first pixel; and a second sensing line connected to the second pixel to supply a second reference voltage to sub-pixels of the second pixel.

The double sampling device includes: a first integrator integrating the current input from the first sensing line; a second integrator integrating the current input from the second sensing line; a subtractor subtracting the output voltage of the first integrator and the output voltage of the second integrator; and an analog-to-digital converter for converting the output voltage of the subtractor into digital data to output ADC data.

In one embodiment, in each of the first and second sensing steps, a first pulse and second pulse of the gate signal are continuously generated.

The first pulse is synchronized with the sensing data voltage or black gradation voltage supplied to the first and second sub-pixels, a current is input to the first integrator through the first sensing line, and a current is input to the second integrator through the second sensing line, when the second pulse is generated.

The second pulse is generated after a predetermined time subsequent to the first pulse.

In one embodiment, in each of the first and second sensing steps, the first and second integrators accumulate input currents to output an output voltage that senses the electrical characteristics of the first and second sub-pixels.

In one embodiment, in each of the first and second initialization steps, third and fourth pulses of the gate signal are continuously generated. The black gradation voltage supplied to the first and second sub pixels is supplied, and the fourth pulse is generated after a predetermined time subsequent to the third pulse.

In one embodiment, in each of the first and second initialization steps, a third pulse of the gate signal is generated.

The black gradation voltage supplied to the first and second sub pixels is supplied, and the third pulse has a pulse width wider than that of each of the first and second pulses.

In one embodiment, in each of the first and second initialization steps, the first and second integrators maintain an initialization state.

In one embodiment, the display device further comprises a compensation unit for modulating the pixel data using the ADC data.

Various embodiments for the method for driving a display device of the present disclosure is summarized as follows.

In one embodiment, a method for driving a display device comprises: setting a first initialization step, a first sensing step, a second initialization step, and a second sensing step in a sensing mode; converting pixel data of an input image into a data voltage to supply the data voltage to the first sub-pixel disposed in the first pixel and the second sub-pixel disposed in the second pixel in a display driving mode; supplying a black gradation voltage to the first and second sub-pixels in the first initialization step; supplying a sensing data voltage to the first sub-pixel, and supplying the black gradation voltage to the second sub-pixel to sense an electrical characteristic of the first sub-pixel using the subtraction result of the sensing data voltage and the black gradation voltage in the first sensing step; supplying the black gradation voltage to the first and second sub-pixels in the second initialization step; and supplying the sensing data voltage to the second sub-pixel, and supplying the black gradation voltage to the first sub-pixel to sense an electrical characteristic of the second sub-pixel using the subtraction result of the sensing data voltage and the black gradation voltage, in the second sensing step.

In one embodiment, the first sub-pixel and the second sub-pixel are sub-pixels of the same color, and are spaced apart from one or more sub-pixels of different colors.

In one embodiment, the first and second sub-pixels are adjacent to each other.

The present disclosure initializes the black value of the odd-numbered pixels and the even-numbered pixels, that is, the state of the pixels before sensing the common noise. Therefore, the present disclosure may accurately sense the electrical characteristics of the pixels by reducing the difference in the result of sensing the common noise between the odd-numbered pixels and the even-numbered pixels.

The effects obtainable in the present disclosure are not limited to the above-mentioned effects, and other effects not mentioned above will be clearly understood by those skilled in the art from the following description.

Since the content of the present disclosure described in the problems to be solved, the problem-solving means, and effects does not specify essential features of the claims, the scope of the claims is not limited to matters described in the content of the disclosure.

While the embodiments of the present disclosure have been described in detail above with reference to the accompanying drawings, the present disclosure is not limited to the embodiments, and various changes and modifications may be made without departing from the technical spirit of the present disclosure. Accordingly, the embodiments disclosed herein are to be considered descriptive and not restrictive of the technical spirit of the present disclosure, and the scope of the technical spirit of the present disclosure is not limited by the embodiments. Therefore, it should be understood that the above embodiments are illustrative rather than restrictive in all respects. The scope of the disclosure should be construed by the appended claims, and all technical spirits within the scopes of their equivalents should be construed as being included in the scope of the disclosure.

What is claimed is:

1. A display device, comprising:

a display panel including data lines, sensing lines, and a first pixel and a second pixel, each of which includes a plurality of sub-pixels having different colors, wherein the plurality of sub-pixels of the first pixel includes a first sub-pixel, and the plurality of sub-pixels of the second pixel includes a second sub-pixel;

a data driving unit converting pixel data of an input image into a data voltage to supply a converted data voltage to the data lines in a display driving mode, and converting sensing data and black gradation data into a voltage to supply to the data lines in a sensing mode;

a gate driving unit supplying a gate signal to the first pixel and the second pixel of the display panel; and a double sampling device sensing electrical characteristics of the first sub-pixel and the second sub-pixel in the sensing mode, wherein the sensing mode includes:

a first sensing step in which the electrical characteristic of the first sub-pixel is sensed, a first initialization step set in advance of the first sensing step, a second sensing step in which the electrical characteristic of the second sub-pixel is sensed, and a second initialization step set in advance of the second sensing step, wherein, a black gradation voltage corresponding to the black gradation data is supplied to the first sub-pixel and the second sub-pixel in the first initialization step, a sensing data voltage corresponding to sensing data is supplied to the first sub-pixel, and the black gradation voltage is supplied to the second sub-pixel so that the electrical characteristic of the first sub-pixel is sensed as a result of subtraction of the sensing data voltage and the black gradation voltage, the black gradation voltage is supplied to the first sub-pixel and the second sub-pixel in the second initialization step, and the sensing data voltage is supplied to the second sub-pixel, and the black gradation voltage is supplied to the first sub-pixel so that the electrical characteristic of the second sub-pixel is sensed as a result of subtraction of the sensing data voltage and the black gradation voltage in the second sensing step.

2. The display device according to claim 1, wherein the first sub-pixel and the second sub-pixel are sub-pixels of the same color, and are separated by one or more sub-pixels of different colors between the first sub-pixel and the second sub-pixel.

3. The display device according to claim 1, wherein the first sub-pixel and the second sub-pixel are adjacent to each other.

4. The display device according to claim 1, wherein each of the first sub-pixel and the second sub-pixel includes a light emitting element, and the electrical characteristics of the first sub-pixel and the second sub-pixel are an operating point voltage or a threshold voltage of the light emitting element and a capacitance of the light emitting element.

5. The display device according to claim 1, wherein each of the first initialization step and the second initialization step is continuously performed one or more times.

6. The display device according to claim 1, wherein each of the first sensing step and the second sensing step is continuously performed one or more times.

7. The display device according to claim 1, further comprising:

a first sensing line connected to the first pixel to supply a first reference voltage to the plurality of sub-pixels of the first pixel; and a second sensing line connected to the second pixel to supply a second reference voltage to the plurality of sub-pixels of the second pixel, wherein the double sampling device includes:

a first integrator integrating a current input from the first sensing line;

a second integrator integrating a current input from the second sensing line;

a subtractor subtracting an output voltage of the first integrator and an output voltage of the second integrator; and an analog-to-digital converter for converting an output voltage of the subtractor into digital data to output analog-to-digital converter ADC data.

8. The display device according to claim 7, wherein in each of the first sensing step and the second sensing step, a first pulse and second pulse of the gate signal are continuously generated, the first pulse is synchronized with the sensing data voltage or black gradation voltage supplied to the first sub-pixel and the second sub-pixels, a current is input to the first integrator through the first sensing line, and a current is input to the second integrator through the second sensing line, when the second pulse is generated, and the second pulse is generated after a predetermined time subsequent to the first pulse.

9. The display device according to claim 8, wherein in each of the first sensing step and the second sensing step, the first integrator and the second integrator accumulate input currents to output an output voltage that senses the electrical characteristics of the first sub-pixel and the second sub-pixel.

10. The display device according to claim 9, wherein in each of the first initialization step and the second initialization step, third and fourth pulses of the gate signal are continuously generated, the black gradation voltage supplied to the first sub-pixel and the second sub-pixels is supplied, and the fourth pulse is generated after a predetermined time subsequent to the third pulse.

11. The display device according to claim 9, wherein in each of the first initialization step and the second initialization step, a third pulse of the gate signal is generated, the black gradation voltage supplied to the first sub-pixel and the second sub-pixels is supplied, and the third pulse has a pulse width wider than that of each of the first pulse and the second pulse.

12. The display device according to claim 11, wherein in each of the first initialization step and the second initialization step, the first integrator and the second integrator maintain an initialization state.

13. The display device according to claim 7, further comprising a compensation unit for modulating the pixel data using the ADC data.

14. A method for driving a display device, comprising:

setting a first initialization step, a first sensing step, a second initialization step, and a second sensing step in a sensing mode;

converting pixel data of an input image into a data voltage, to supply a converted data voltage to a first sub-pixel disposed in a first pixel and a second sub-pixel disposed in a second pixel in a display driving mode;

supplying a black gradation voltage to the first sub-pixel and the second sub-pixel in the first initialization step;

supplying a sensing data voltage to the first sub-pixel, and supplying the black gradation voltage to the second sub-pixel to sense an electrical characteristic of the first sub-pixel using the subtraction result of the sensing data voltage and the black gradation voltage in the first sensing step;

supplying a black gradation voltage to the first sub-pixel and the second sub-pixel in the second initialization step; and supplying the sensing data voltage to the second sub-pixel, and supplying the black gradation voltage to the first sub-pixel to sense an electrical characteristic of the second sub-pixel using the subtraction result of the sensing data voltage and the black gradation voltage, in the second sensing step.

15. The method according to claim 14, wherein the first sub-pixel and the second sub-pixel are sub-pixels of the same color, and are spaced apart from each other by one or more sub-pixels of different colors.

16. The method according to claim 14, wherein the first sub-pixel and the second sub-pixel are adjacent to each other.

* * * * *